US009371621B2

(12) United States Patent
Norkus et al.

(10) Patent No.: US 9,371,621 B2
(45) Date of Patent: Jun. 21, 2016

(54) SPREADER ASSEMBLY

(71) Applicant: Louis Berkman Company, Steubenville, OH (US)

(72) Inventors: Christopher Norkus, Creston, IL (US); James Schaefer, Cherry Valley, IL (US)

(73) Assignee: Swenson Spreader, LLC, Lindenwood, IL (US)

( * ) Notice: Subject to any disclaimer, the term of this patent is extended or adjusted under 35 U.S.C. 154(b) by 0 days.

(21) Appl. No.: 14/727,117

(22) Filed: Jun. 1, 2015

(65) Prior Publication Data

US 2015/0259867 A1 Sep. 17, 2015

Related U.S. Application Data

(62) Division of application No. 13/787,491, filed on Mar. 6, 2013, now Pat. No. 9,085,862.

(60) Provisional application No. 61/607,544, filed on Mar. 6, 2012.

(51) Int. Cl.

| | |
|---|---|
| ***A01C 7/06*** | (2006.01) |
| ***E01H 10/00*** | (2006.01) |
| ***E01C 19/20*** | (2006.01) |

(52) U.S. Cl.

CPC ..... *E01H 10/007* (2013.01); *E01C 19/20* (2013.01); *E01C 19/202* (2013.01); *E01C 2019/208* (2013.01)

(58) Field of Classification Search

CPC . A01C 17/003; E01C 19/20; E01C 2019/208; E01C 2019/209; E01C 19/21; E01C 19/202; E01H 10/007

USPC ..... 239/650–689, 146–176, 722–754, 7

See application file for complete search history.

(56) References Cited

U.S. PATENT DOCUMENTS

| | | | | |
|---|---|---|---|---|
| 4,157,150 | A | 6/1979 | Hetrick | |
| 4,166,581 | A | 9/1979 | Hetrick | |
| 4,261,520 | A | 4/1981 | Hetrick | |
| 5,842,649 | A | 12/1998 | Beck | |
| 5,931,393 | A * | 8/1999 | Alsip | E01C 19/205 239/654 |
| 5,950,934 | A | 9/1999 | Podesta et al. | |
| 6,715,703 | B2 | 4/2004 | Kost | |
| 6,722,590 | B2 | 4/2004 | Kost | |
| 7,370,818 | B2 * | 5/2008 | Ward | E01H 10/007 239/146 |
| 2007/0069044 | A1 * | 3/2007 | Sandler | E01C 19/203 239/146 |
| 2007/0262179 | A1 * | 11/2007 | Larsen | E01C 19/203 239/662 |
| 2009/0032624 | A1 * | 2/2009 | Truan | E01C 19/203 239/675 |

* cited by examiner

*Primary Examiner* — Justin Jonaitis
*Assistant Examiner* — Juan C Barrera
(74) *Attorney, Agent, or Firm* — Roger D. Emerson; Timothy D. Bennett; Emerson Thomson Bennett

(57) ABSTRACT

A spreader assembly may include a hopper having a receptacle for holding salt, or the like, and at least one chamber formed between the receptacle and an outer surface of the hopper. The chamber may hold a liquid used to pre-wet the salt before it contacts a ground surface. The hopper may be an insert hopper formed as a one piece plastic component in a rotational molding operation.

20 Claims, 25 Drawing Sheets

SPREADER ASSEMBLY

This application is a divisional of U.S. patent application Ser. No. 13/787,491 filed Mar. 6, 2013, entitled SPREADER ASSEMBLY, which claims the benefit of U.S. Provisional Patent Application No. 61/607,544 filed Mar. 6, 2012, entitled SPREADER ASSEMBLY, the contents of which are incorporated herein by reference.

I. BACKGROUND

A. Field of the Invention

This invention generally relates to apparatuses and methods for spreading salt, or the like, onto road surfaces.

B. Description of Related Art

Spreaders are known devices used to spread salt, sand, anti-icing fluids or other such materials onto to road surfaces to treat the road surfaces for snow and ice. It is well known to provide smaller spreaders which have a hopper that may be selectively mounted into the bed of pickup trucks. Such spreaders are known as insert hopper spreaders. It is also known to provide larger spreaders which have hoppers that are permanently or semi-permanently mounted to large over-the-road trucks such as those used in municipalities and on highways and the like. The present invention is initially designed for the insert hopper spreaders, although some of its features are widely applicable to spreaders in general.

II. SUMMARY

According to one embodiment of this invention, a method for a spreader assembly may comprise the steps of: (A) forming an insert hopper into a one piece plastic component in a rotational molding operation; (B) providing the insert hopper with: an inner surface defining a receptacle; an outer surface; a first chamber formed between the inner surface and the outer surface; a first aperture formed on the outer surface that communicates with the receptacle; and, a second aperture formed on the outer surface that communicates with the first chamber; (C) providing a first mechanism that is supported to the hopper; (D) providing a second mechanism that is supported to the hopper; and, (E) providing a chute assembly supported to the hopper, wherein the first and second apertures extend to an intake of the chute assembly. The spreader assembly may be operable to perform the following steps: (1) mounting the insert hopper onto a bed of a pick-up truck; (2) placing a solid material into the receptacle; (3) placing a liquid material into the first chamber; (4) operating the first mechanism to move the solid material from the receptacle, to the first aperture and, onto a ground surface; and, (5) operating the second mechanism to move the liquid material from the first chamber, to the second aperture and, onto the solid material before the solid material contacts the ground surface.

According to another embodiment of this invention, a method for a spreader assembly may comprise the steps of: (A) providing an insert hopper with: an inner surface defining a receptacle; an outer surface; first and second chambers formed between the inner surface and the outer surface on opposite sides of the receptacle; a first aperture formed on the outer surface that communicates with the receptacle; and, a second aperture formed on the outer surface that communicates with the first and second chambers; (B) providing a first mechanism that is supported within the hopper; (C) providing a second mechanism that is supported to the hopper; and, (D) providing a chute assembly supported to the hopper, wherein the first and second apertures extend to an intake of the chute assembly. The spreader assembly may be operable to perform the following steps: (1) mounting the insert hopper onto a bed of a pick-up truck; (2) placing a solid material into the receptacle; (3) placing a liquid material into the first and second chambers; (4) operating the first mechanism to move the solid material from the receptacle, to the first aperture and, onto a ground surface; and, (5) operating the second mechanism to move the liquid material from the first and second chambers, to the second aperture.

Various benefits and advantages of this invention will become apparent to those skilled in the art to which it pertains upon reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION

Figure 1:
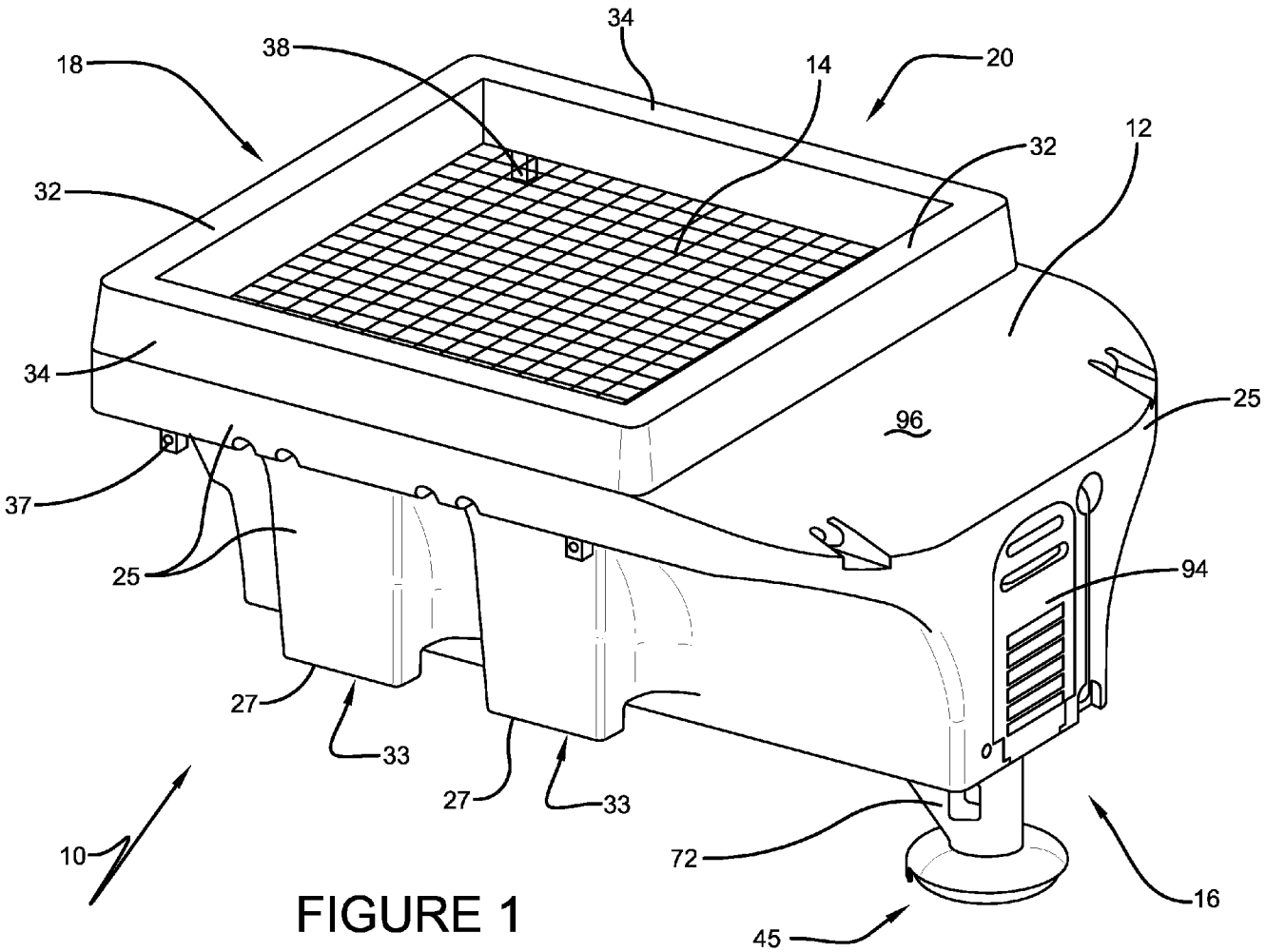
FIG. 1 is a perspective view of an exemplary embodiment of the invention.
Figure 2:
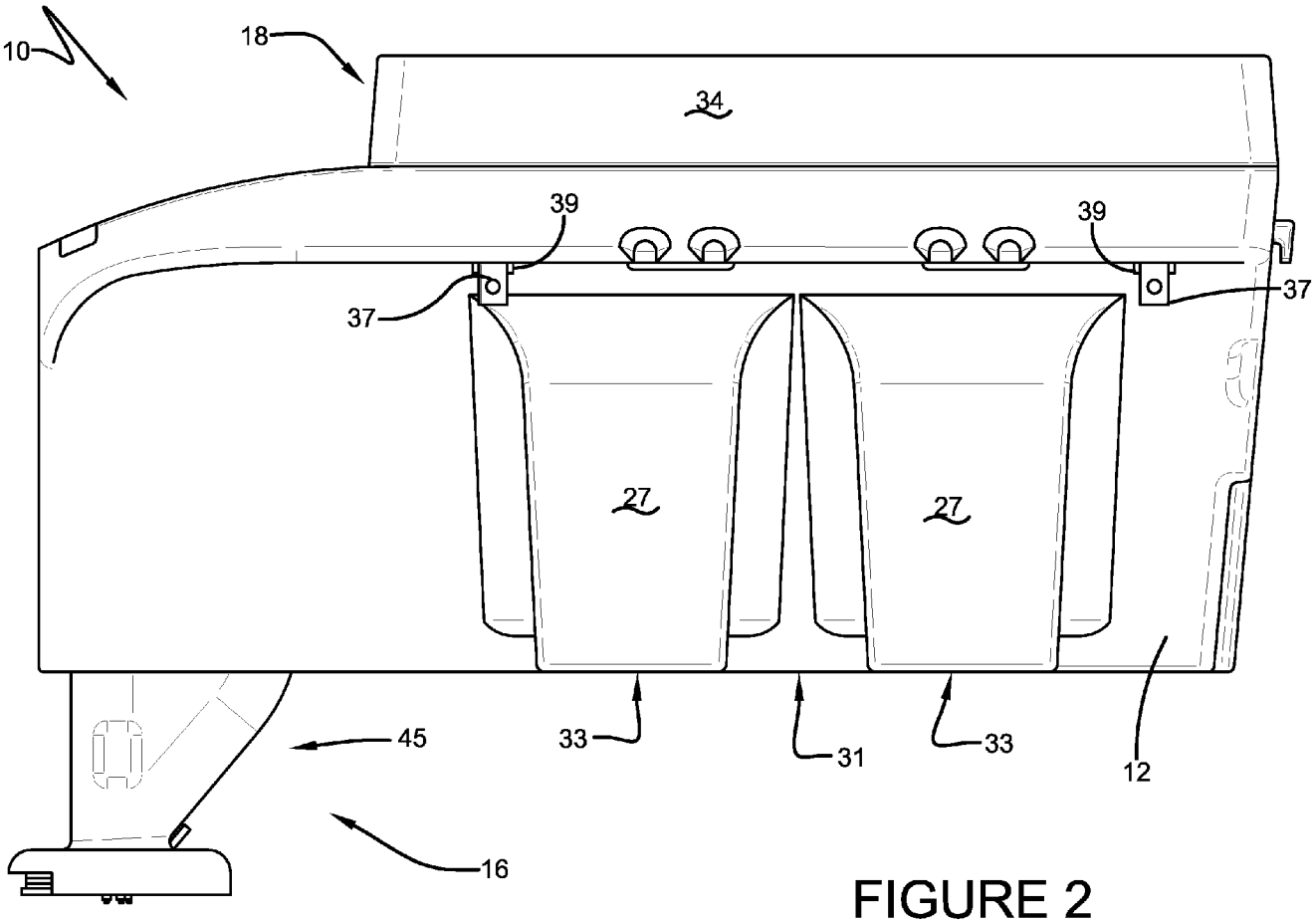
FIG. 2 is a left-hand view of the exemplary embodiment of the invention shown in FIG. 1.
Figure 3:
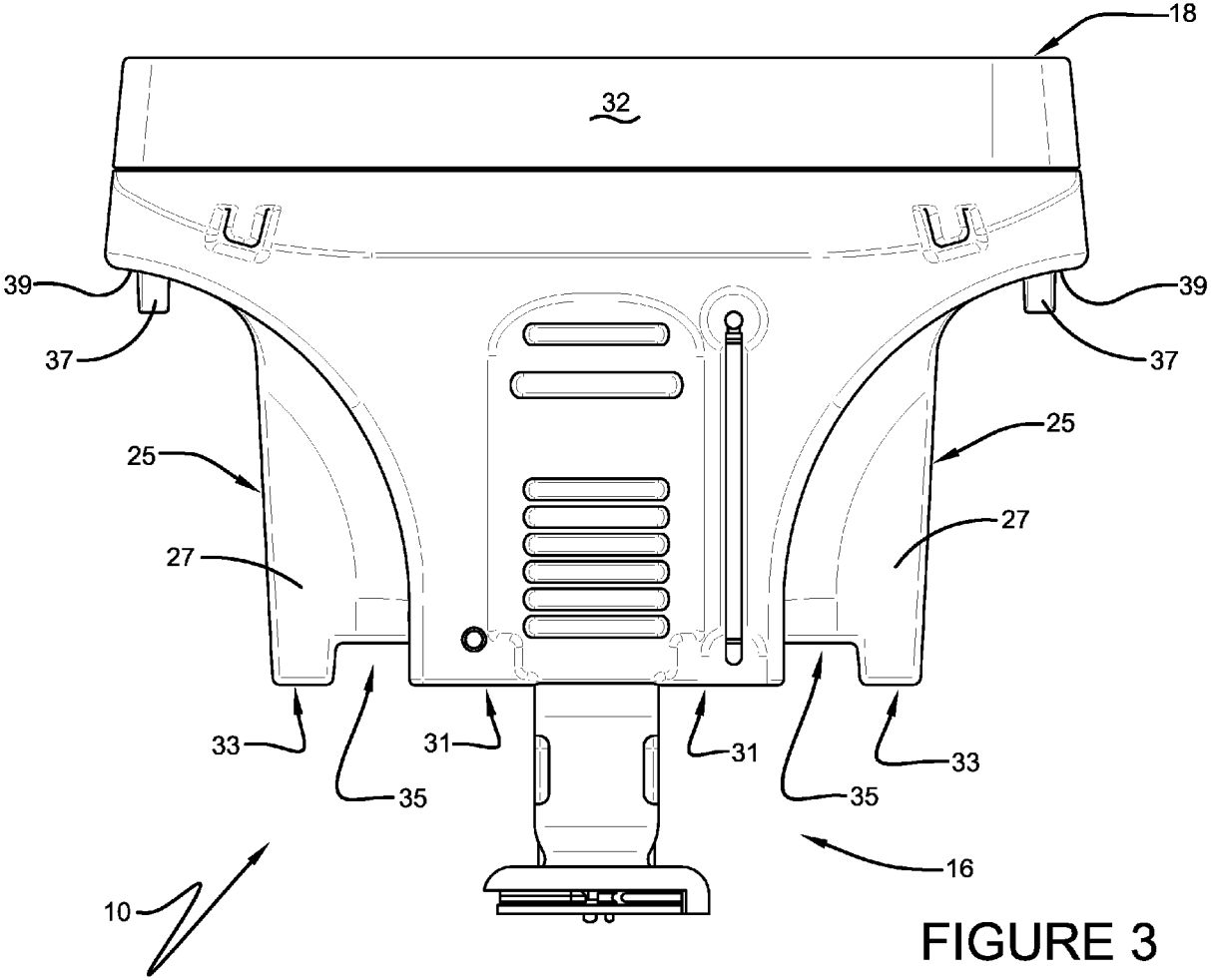
FIG. 3 is a back view of the exemplary embodiment of the invention shown in FIG. 1.
Figure 4:
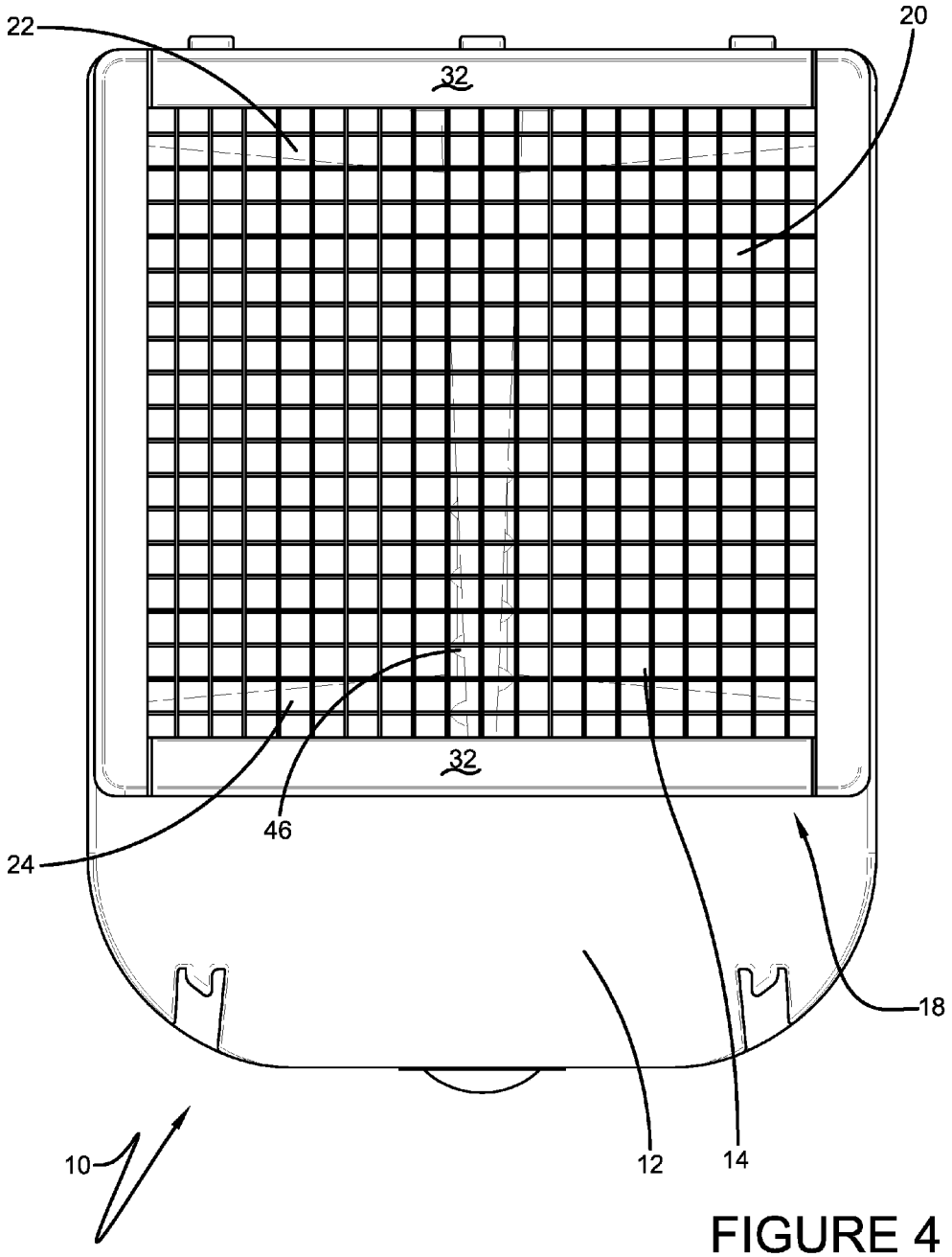
FIG. 4 is a top view of the exemplary embodiment of the invention shown in FIG. 1 (the rear of the embodiment, adjacent to the rear of a vehicle is at the bottom of the Figure)

Referring now to the drawings wherein the showings are for purposes of illustrating embodiments of the invention only and not for purposes of limiting the same, and wherein like reference numerals are understood to refer to like components, FIGS. 1-4 show embodiments of a spreader assembly 10 and FIGS. 23-27 show embodiments of a spreader assembly 100. The spreader assemblies 10, 100 may have similar features but that is not a requirement. The spreader assembly 10 may include a hopper 12, a screen 14, a chute assembly 16, and a receptacle extension assembly 18. The hopper 12 may be a one piece plastic component formed in a rotational molding operation. The hopper 12 may be, as shown, an insert hopper sized and shaped to be received on a bed of a pick-up truck (not shown). The spreader assembly 100 may also include a hopper 102 that may be a one piece plastic component formed in a rotational molding operation. The hopper 102 may be, as shown, an insert hopper sized and shaped to be received on a bed 172 of a pick-up truck 174. The hoppers 12, 102 may be doublewalled, rotationally molded plastic structures. As a result, the hoppers 12, 102 may have hollow portions which will be discussed further below.

Figure 5:
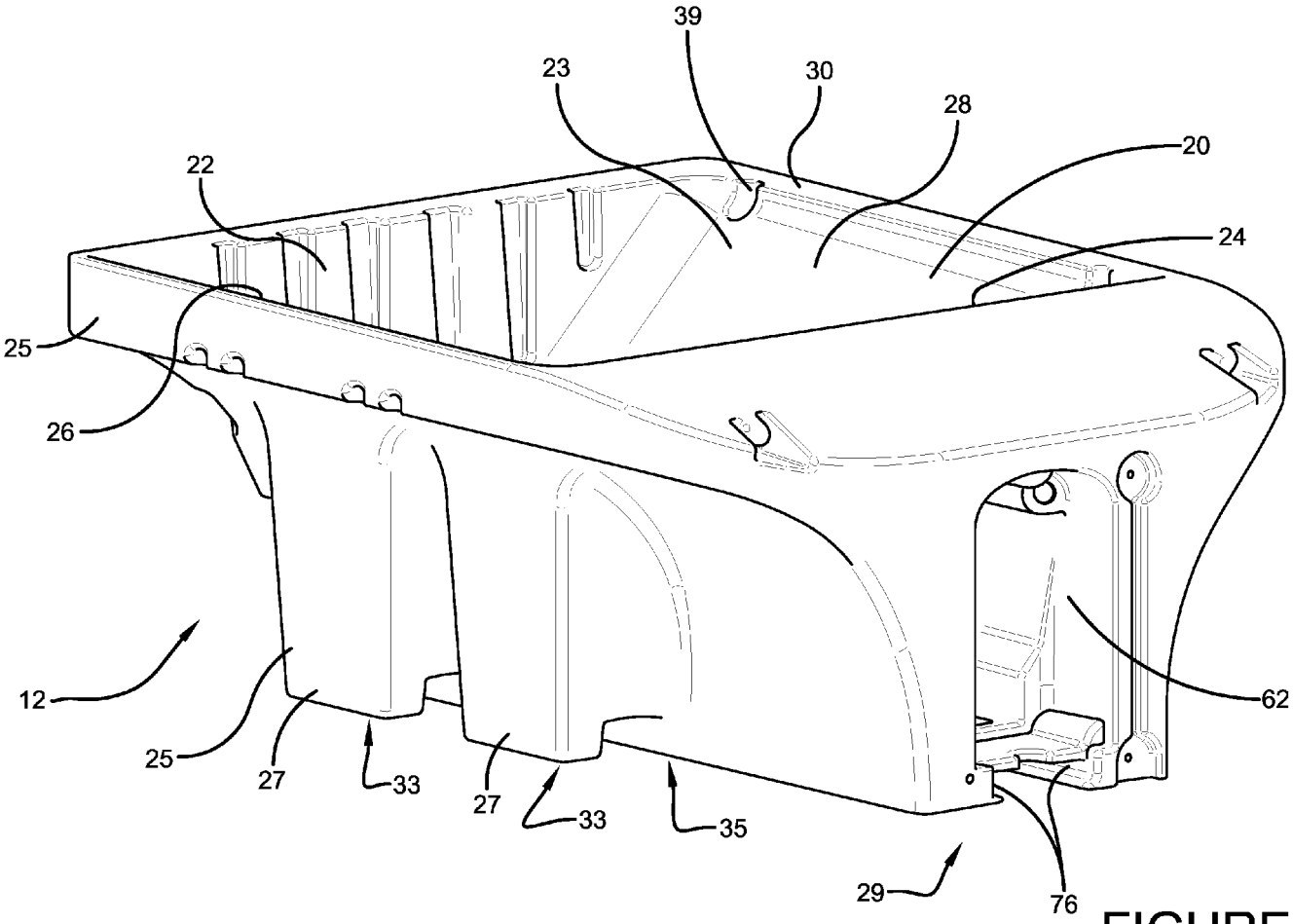
FIG. 5 is a first perspective view of a hopper of the exemplary embodiment.
Figure 24:
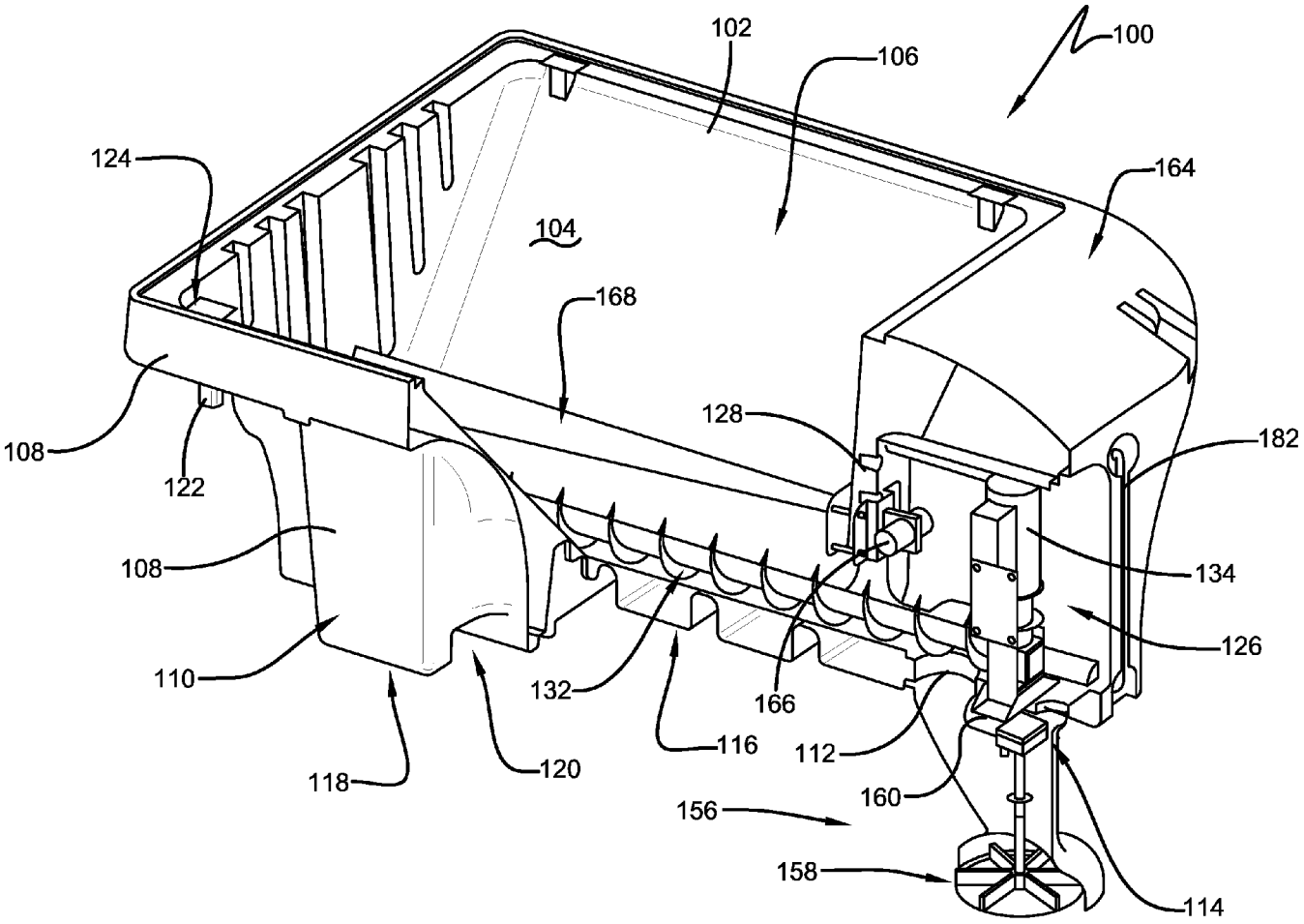
FIG. 24 is a perspective view, partially cut-away, of the hopper shown in FIG. 23.
Figure 25:
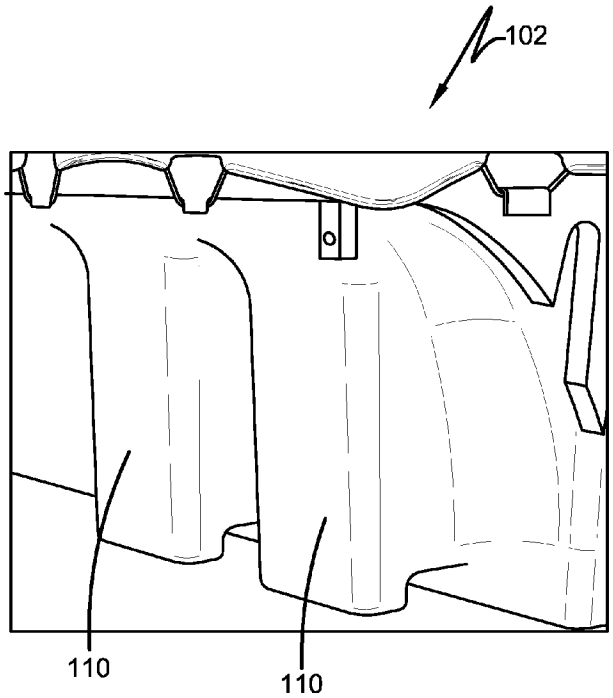
FIG. 25 is a partial side view of the hopper shown in FIG. 23.
Figure 26:
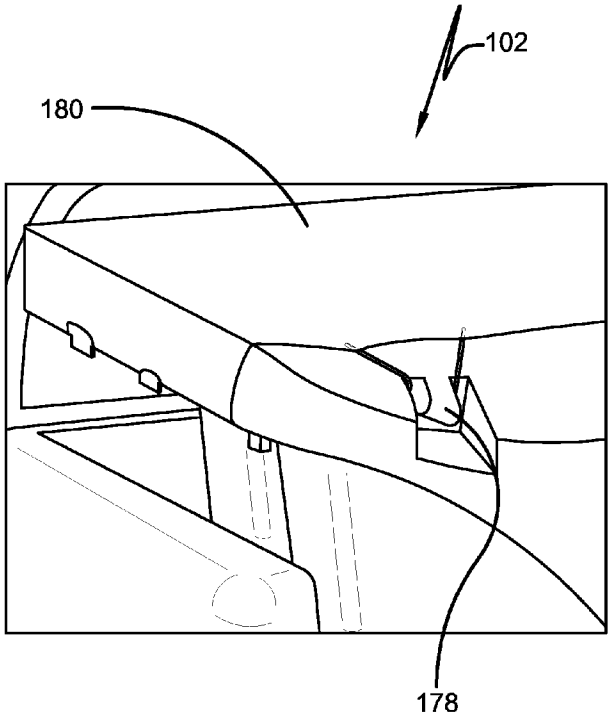
FIG. 26 is a partial back view of the hopper shown in FIG. 23.

With reference to FIGS. 5 and 24, each hopper 12, 102 may have an inner surface 23, 104 defining a receptacle 20, 106. The receptacle 20, 106 may be used to hold a solid material, such as salt, sand, or the like, that is used to treat a ground surface in a known way. As best seen in FIG. 5, the receptacle 20 may be formed by a front surface 22, a rear surface 24, a first side surface 26, and a second side surface 28. The front and rear surfaces 22, 24 may be generally vertical. The first and second side surfaces 26, 28 may be at least partially angled, resulting in the receptacle 20 being trough-like and converging at the bottom of the receptacle 20. The front surface 22 of the hopper 12 may be positioned adjacent to the front of a vehicle carrying the spreader assembly 10, that is, the pick-up truck cab. The rear surface 24 may be positioned adjacent to the back/rear of the pick-up truck and it is at the rear of the spreader assembly 10 where the material carried within the hopper 12 may be eventually discharged onto a ground surface, such as a road surface. The receptacle 106 of hopper 102 may have a similar design to hopper 12, as shown in FIG. 24. The receptacles 20, 106 may communicate with apertures 60 (FIG. 6), 112 so that the contents of the receptacles may be applied to the ground surface. The hoppers 12, 102 may have respective bottom surfaces 31, 116 that are positioned directly below the respective receptacle 20, 106 that contact the bed of the pick-up truck when the hopper is on the bed.

Figure 6:
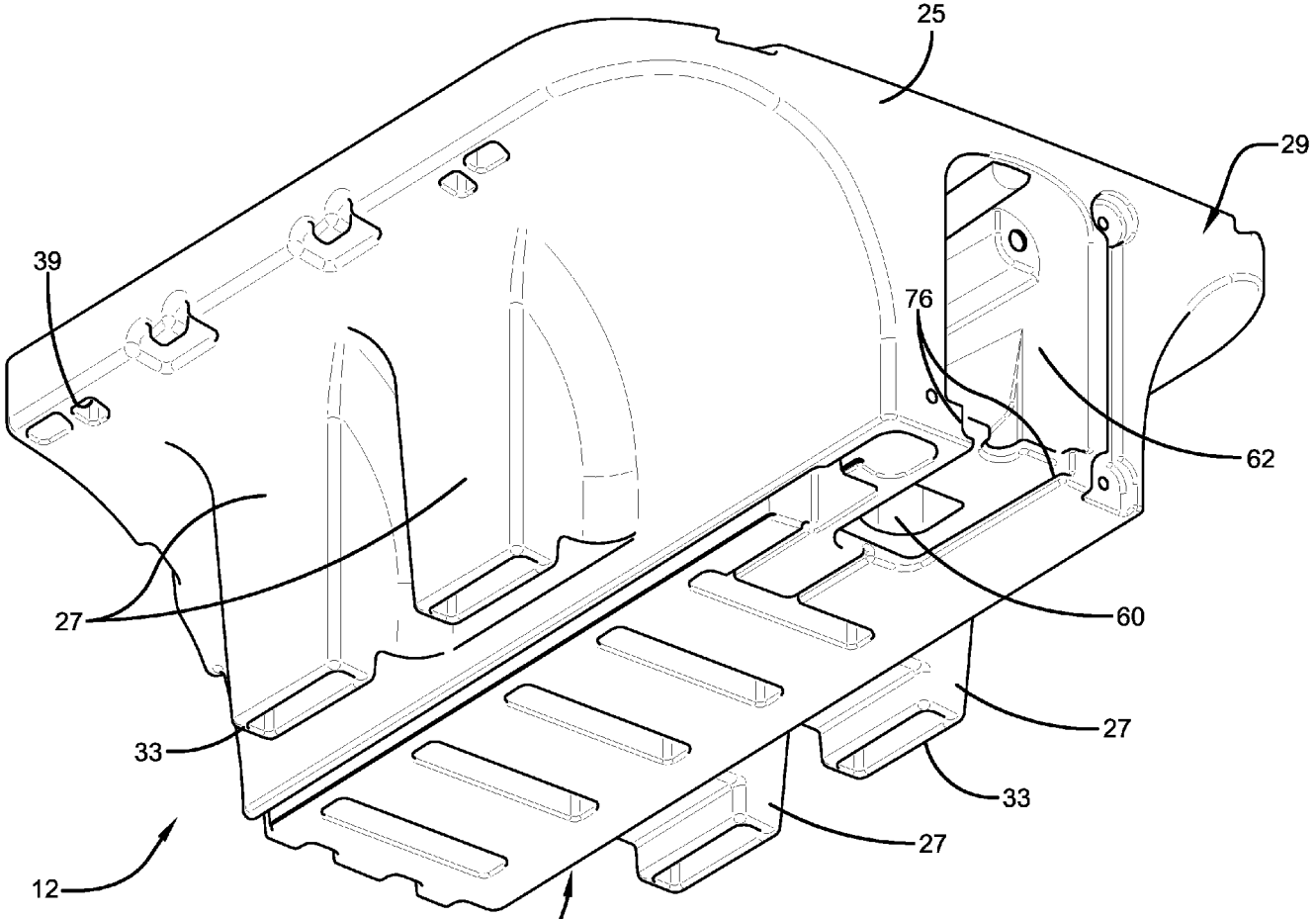
FIG. 6 is a second perspective view of a hopper of the exemplary embodiment.
Figure 7:
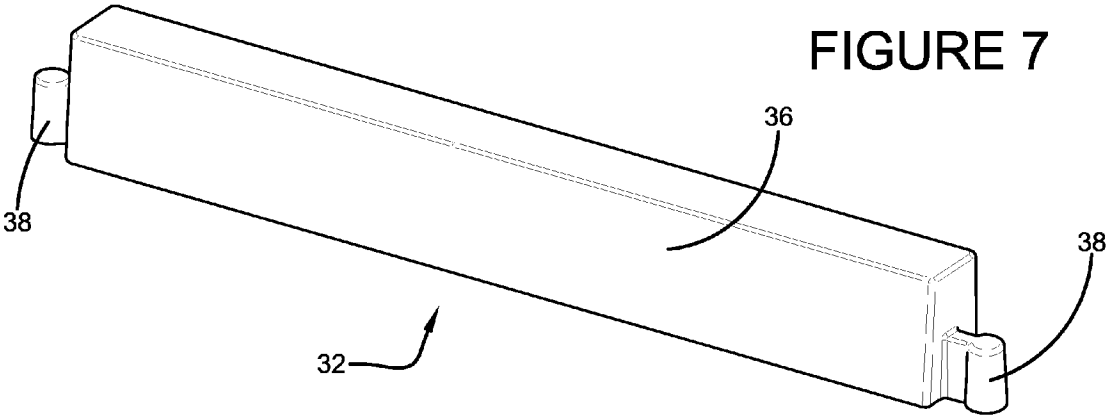
FIG. 7 is a perspective view of an end extension of the exemplary embodiment.
Figure 8:
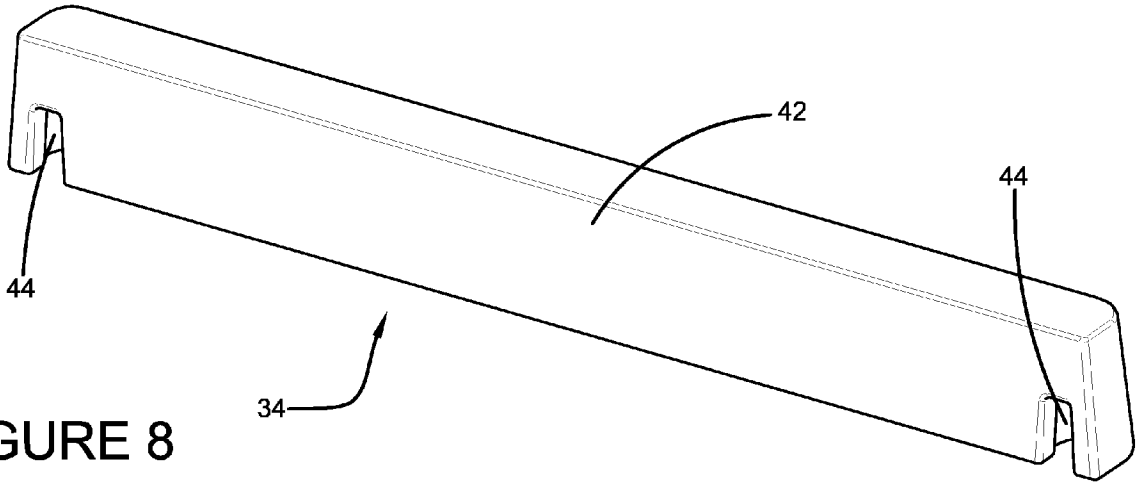
FIG. 8 is a perspective view of a side extension of the exemplary embodiment.
Figure 9:
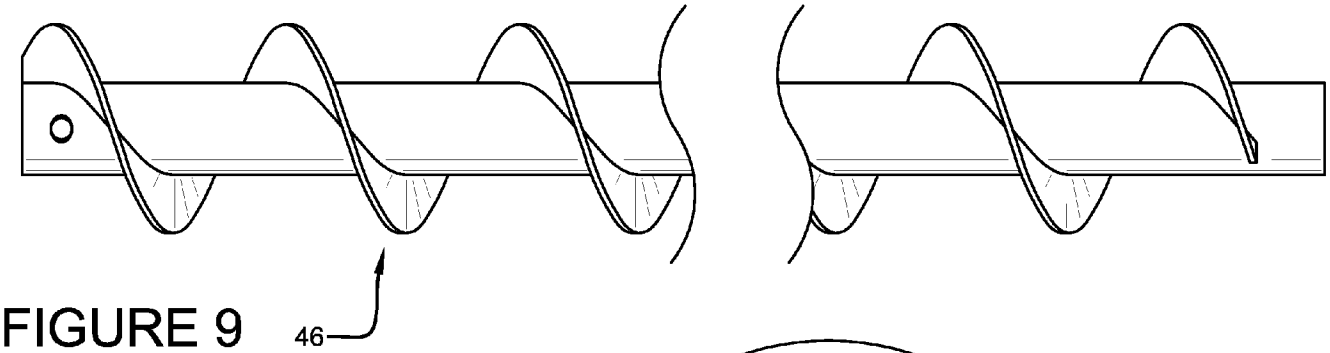
FIG. 9 is a broken side view of an auger of the exemplary embodiment of the invention.
Figure 10:
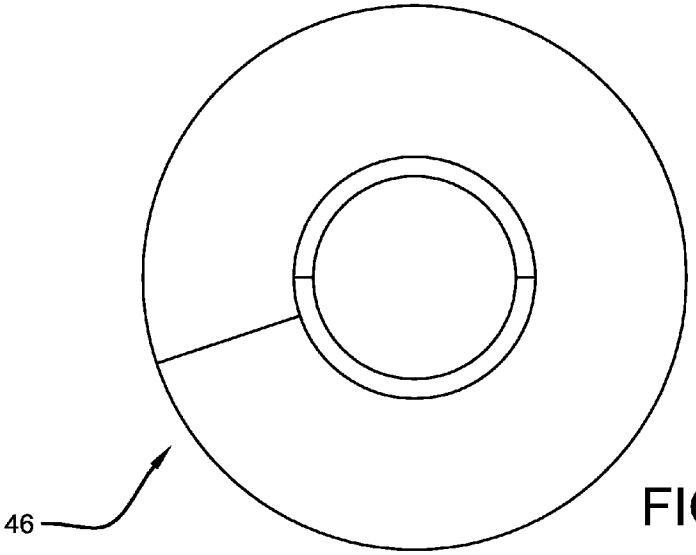
FIG. 10 is an end view of auger of the exemplary embodiment of the invention.

With continuing reference to FIGS. 5, 6 and 24, each hopper 12, 102 may have an outer surface 25, 108. The apertures 60, 112 may extend to the outer surfaces 25, 108, as shown, and communicate with the respective receptacles 20, 106. The hoppers 12, 102 may have hollow portions as mentioned above. In one embodiment, shown in FIGS. 1-6 and 24-25 and 35, hollow portions between the inner surfaces 23, 104 and the outer surfaces 25, 108 define at least one chamber 27, 110 into which is stored a liquid material that may be used to treat the ground surface. The chamber(s) 27, 110 may communicate with respective apertures 29, 114 that extend to the respective outer surfaces 25, 108. In one embodiment, the liquid material is an anti-icing agent, such as salt brine, that is used to pre-wet the solid material before the solid material contacts the ground surface. This pre-wetting improves material performance, distribution and adhesion to the ground/road surface. For the embodiments shown, there may be two chambers 27, 27, 110, 110, on each (opposite) side of the hopper 12, 102. Each chamber 27, 110 may have a respective bottom surface 33, 118 that contacts the bed of the pick-up truck when the hopper is positioned on the bed and that are laterally outside the respective bottom surface 31, 116 of the hopper positioned directly below the receptacle. In one embodiment, a groove 35, 120 separates each of the bottom surfaces 33, 118 of the chambers and the bottom surfaces 31, 116 of the hopper. This groove 35, 120 may be used as a lifting pocket that makes it easy to mount/install and remove the hopper 20, 102 from the respective pick-up truck. In one embodiment, the groove 35, 120 is at least 1.0 inch wide. In another embodiment, the groove 35, 120 is at least 2.0 inches wide.

With reference to FIGS. 1-5, the screen 14 may be desirable to prevent large debris from being received in the receptacle 20. The screen 14 may also desirably cause clumps of salt to be broken during filling of the hopper 12. The screen 14 may be received in a track 30 integrally-formed within the hopper 12. "Integrally-formed" refers to the fact that in the exemplary embodiment the hopper 12 and the track 30 are formed together rather than being formed separately and then subsequently joined. The term defines a structural feature since structures that are integrally-formed are structurally different than structures that are comprised of subcomponents formed separately and then subsequently joined. "Integral" means consisting or composed of parts that together constitute a whole and thus encompasses structures of more than one part wherein the parts are either integrally-formed or formed separately and then subsequently joined. The exemplary track 30 extends around the full perimeter of the opening of the receptacle 20. The cooperation between the screen 14 and the track 30 locates the screen 14 relative to the hopper 12.

With reference to FIGS. 1-4, the receptacle extension assembly 18 may attach to the hopper 12 around the perimeter of the receptacle 20. The receptacle extension assembly 18 may overlay the perimeter of the screen 14. The extension assembly 18 may be desirable to prevent salt from pouring over the sides of the hopper 12 during filing. As best seen in FIGS. 1-4, 7 and 8, the exemplary extension assembly 18 may include four wall extensions; specifically, a pair of end wall extensions 32 and a pair of side wall extensions 34. The side extensions 34 may include a wall portion 42 and slots 44 on opposite ends, as shown. The end extensions 32 may have a wall portion 36 and keys on opposite ends, as shown. The keys 38 may be received in the slots 40 to attach the wall extensions together. It is also contemplated to use a key 38 on one end of each wall extension and one slot 44 on the opposite end of each wall extension. At least one pin 37 may extend from at least one of the wall extensions and may be received in a corresponding slot 39 formed in the hopper 12 to attach the receptacle extension assembly 18 to the hopper 12. When a screen 14 is used, the pins 37 may extend through an opening of the screen 14 and into one of the slots 40. For the embodiment shown in FIGS. 1-4, two pins 37, 37 extend downward from opposite ends of each side wall extension 34. FIG. 24 shows that fill pins 122 may be used to fill the slots 124 when a receptacle extension assembly 18 is not used, if desired.

With reference to FIGS. 5-6, 16-17, 24 and 37, each hopper 12, 102 may have a well 62, 126 formed on the back end of the respective hopper 12, 102 and the well 62, 126 may be separated from the respective receptacle 20, 106 by a wall 41, 128. The well 62, 126 may have a bottom surface on which the respective apertures 60, 112 and 29, 114 are formed. A cover 94, 130 may be used to enclose each respective well 62, 126. With reference to FIG. 24, the hopper 102 may include a vibrator 166, mounted to the wall 128, and a material guide 168, mounted to the inner surface 104, which can be used in a known manner.

With reference to FIGS. 9, 16-17, 24 and 37, the spreader assemblies 10, 100 may include a first mechanism that is supported to the hopper 12, 102 and used to move the solid material from the receptacle 20, 106 to the respective aperture 29, 112. In one embodiment, the first mechanism is an auger 46, 132, as shown, that extends from the receptacle 20, 106 through the respective wall 41, 128 and into the respective well 62, 126. A drive 134 may be attached to the end of the auger 132 (and 46) and used to drive/operate the respective auger 46, 132. The drive 134 may include and incorporate any desired gearing and connections for any fuel source, including electrical, hydraulic, gasoline, and diesel. For the embodiment shown, the drive 134 is positioned within the well 126. Access to the drive 134 is then easy as the operator must only remove the cover 94, 130, see FIGS. 1, 3, 23 and 33 to access all components within the well 62, 126. Rotation of the auger 46, 132 causes solid material to be drawn out of the respective receptacle 20, 106 and to be communicated to the respective aperture 60, 112 where it leaves the hopper 12, 102.

Figure 11:
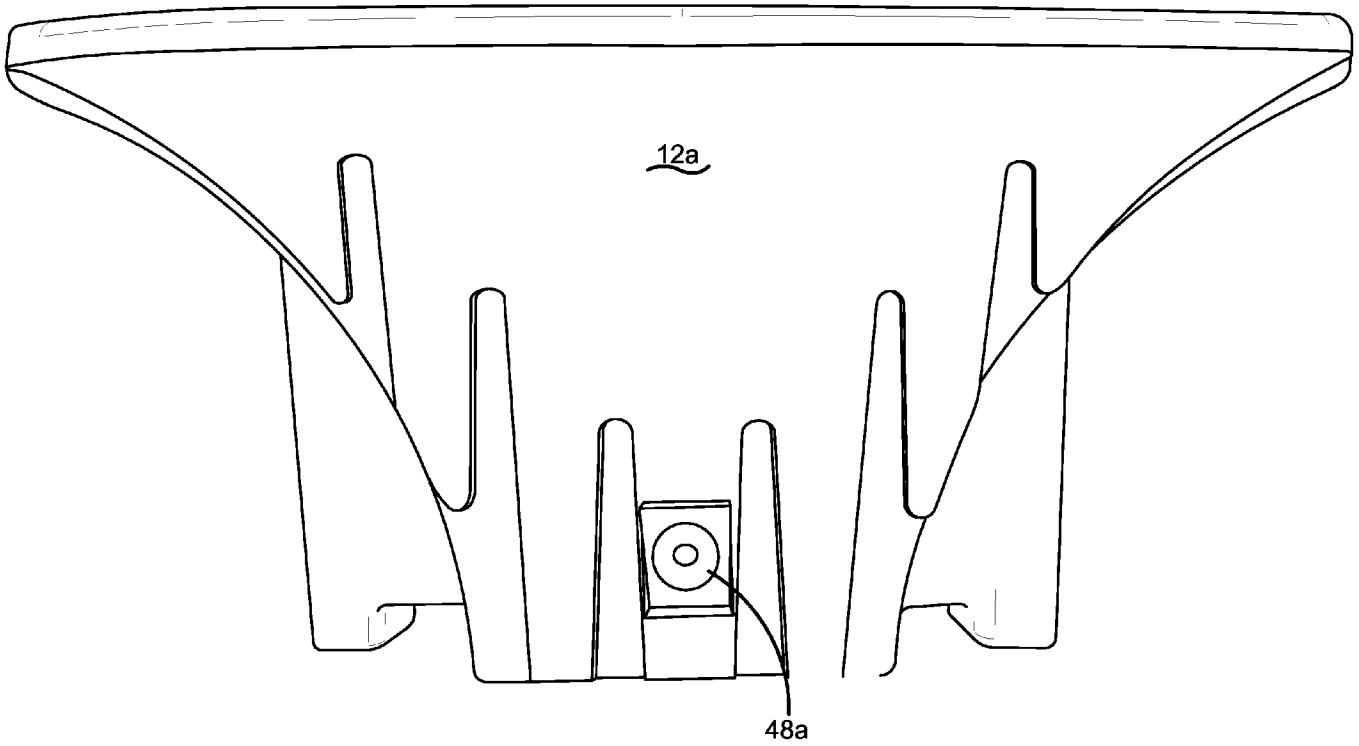
FIG. 11 is a perspective view of an alternative hopper.
Figure 12:
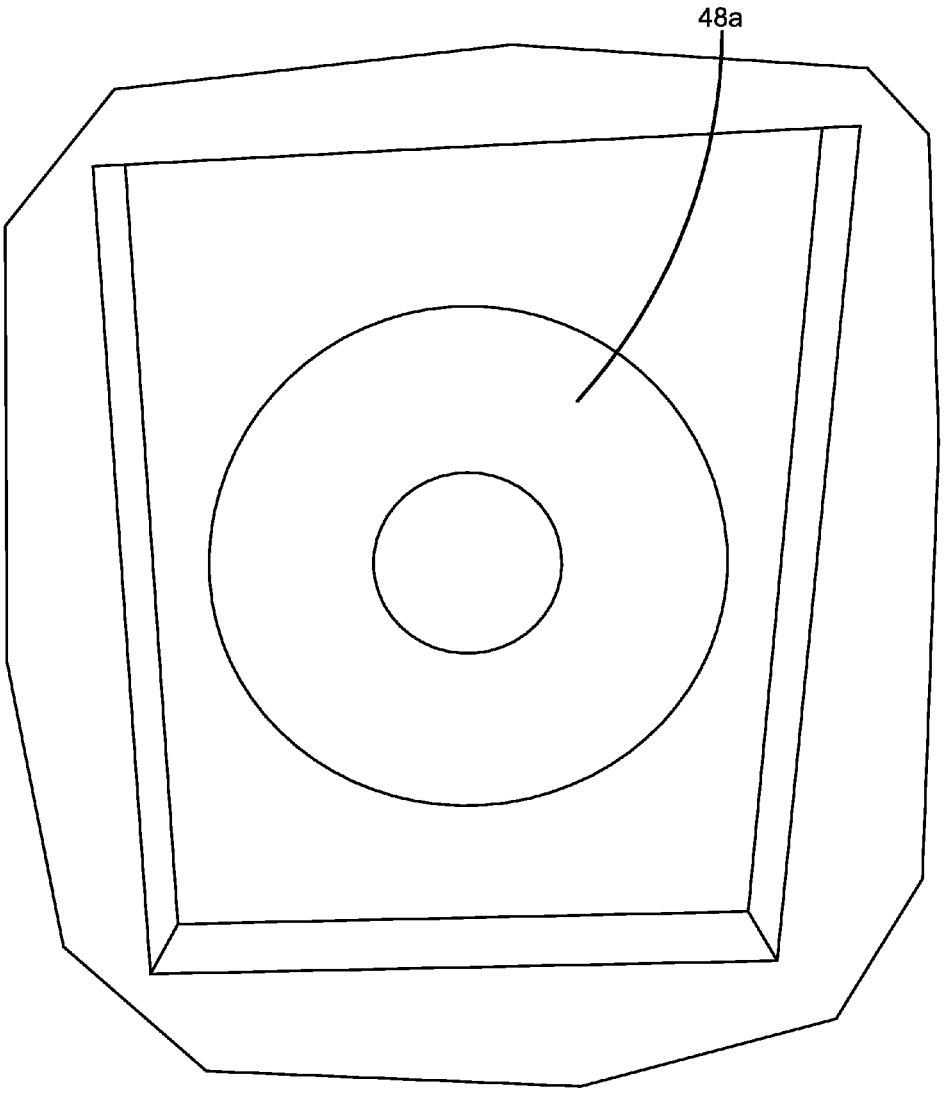
FIG. 12 is a magnified view showing a portion of FIG. 11.
Figure 15:
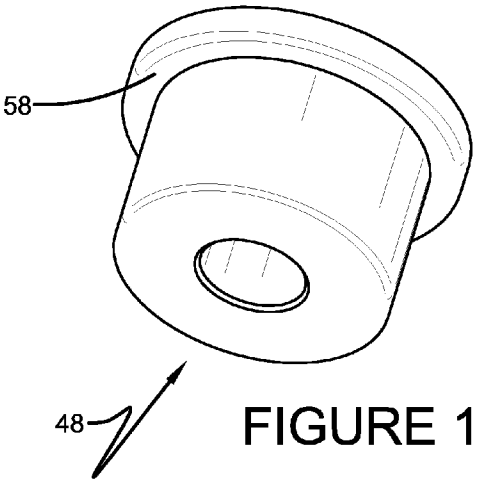
FIG. 15 is a perspective view of the bearing shown in FIGS. 13 and 14.
Figure 14:
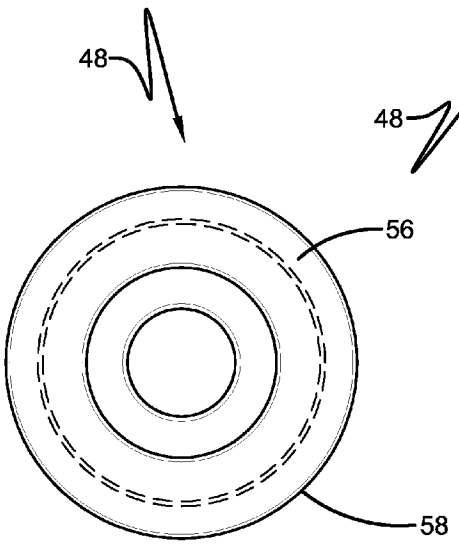
FIG. 14 is a front view of the bearing shown in FIG. 13.
Figure 13:
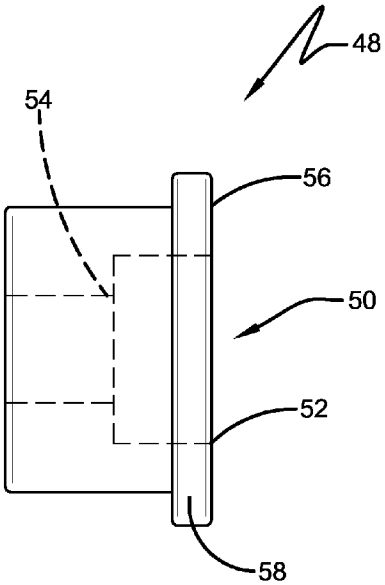
FIG. 13 is a side view of a bearing that may be used in embodiments of the invention.

The auger 46 may be supported for rotation in the bottom of the receptacle 20. FIGS. 11 and 12 show an alternative embodiment of a hopper 12*a*. A bearing 48*a* may be positioned inside the mold cavity when the hopper 12*a* is formed, thus being at least partially overmolded with respect to the hopper 12*a*. One end of the auger 46 may be received in the bearing 48*a* and thereby supported for rotation. The hopper 12 may be similarly overmolded with respect to a bearing. Mechanical, multi-component bearings may be used in embodiments of the invention. In the exemplary embodiment of the invention, this bearing is made of Ultra High Molecular Weight Plastic "UMHW," which is self-lubricating. FIGS. 13-15 show an exemplary bearing 48 that may be used with the hopper 12. An end of the auger 46 may be received in an aperture 50 of the bearing 48. The auger 46 may enter an opening 52 of the aperture 50. The aperture 50 may include a shoulder 54 that limits movement of the auger 46. A surface 56 of a flange portion 58 of the bearing 48 may be flush with the surface 22 of the hopper 12 or may be recessed into the surface 22, but be exposed in the receptacle 20. The flange 48 may act as a thrust bearing.

Figure 16:
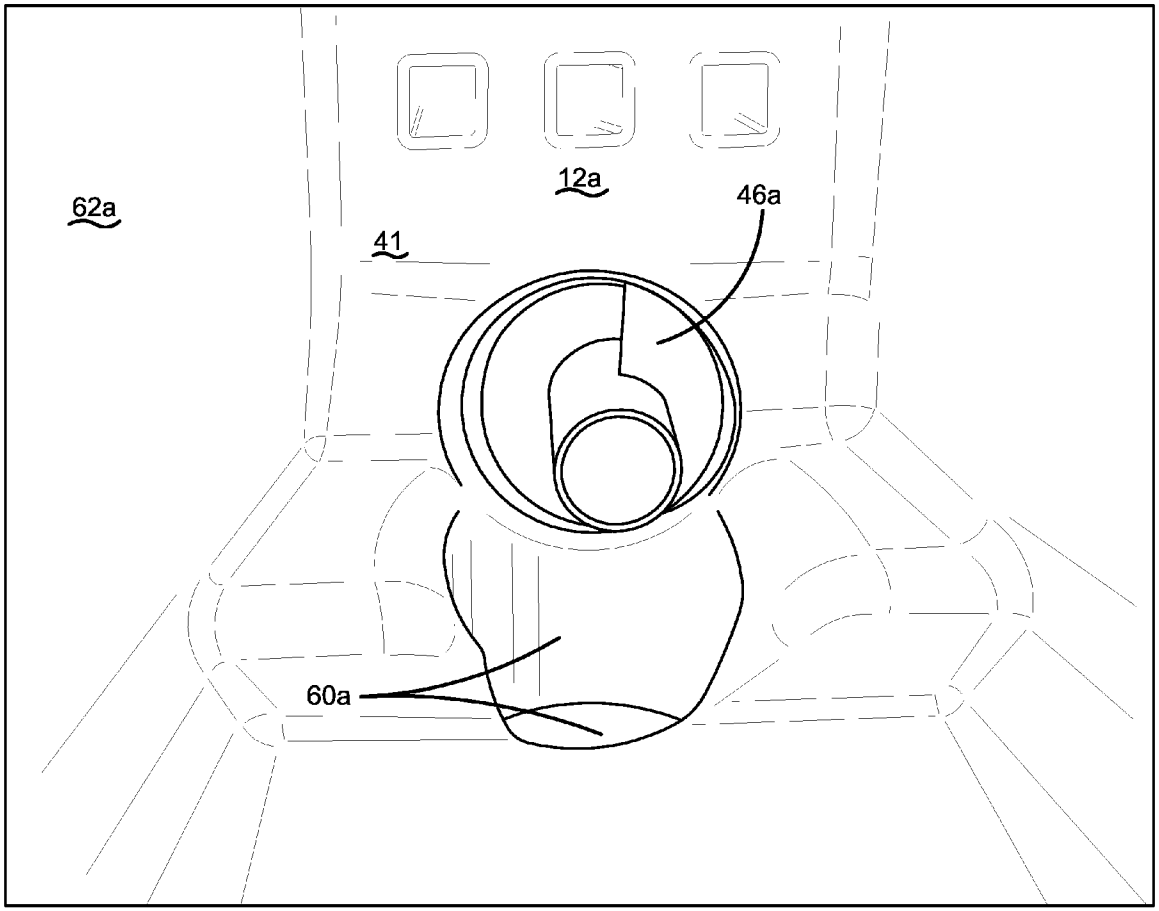
FIG. 16 is a perspective view of an end of an auger protruding out of a hopper according to an alternative embodiment.
Figure 17:
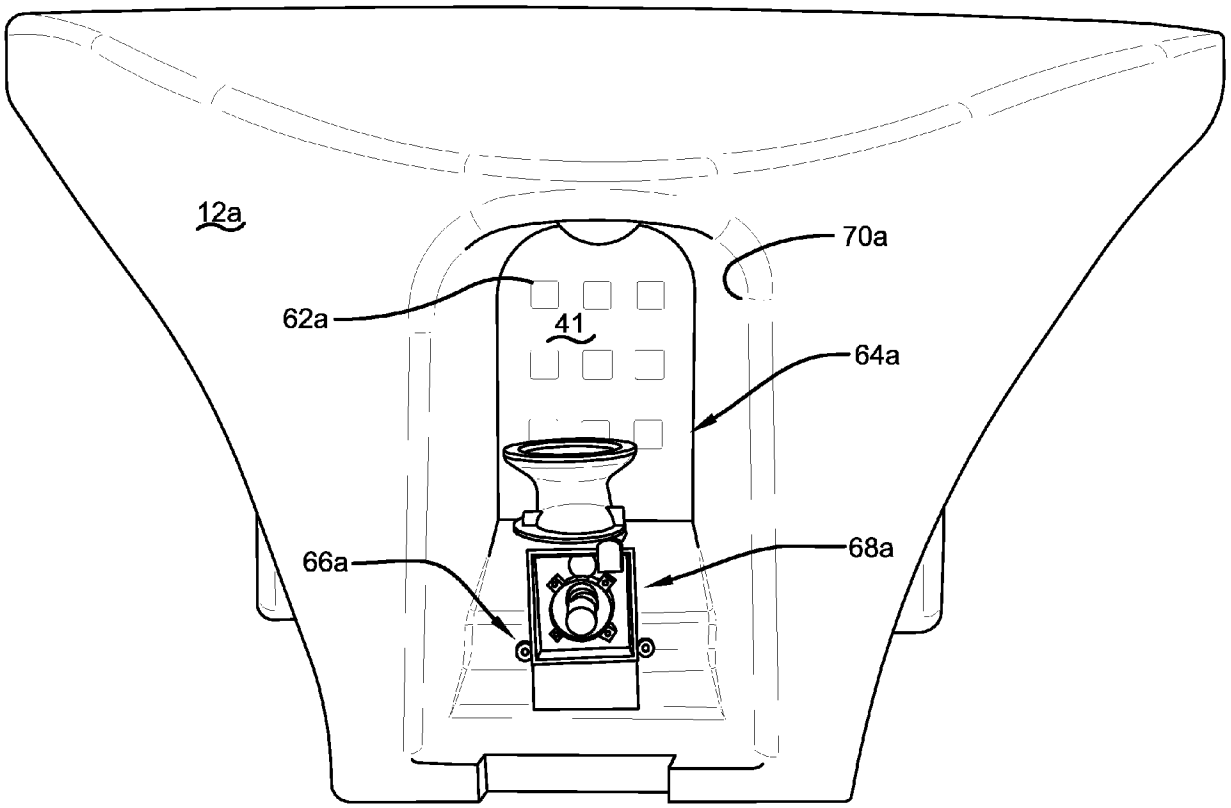
FIG. 17 is a perspective view of an alternative hopper.
Figure 18:
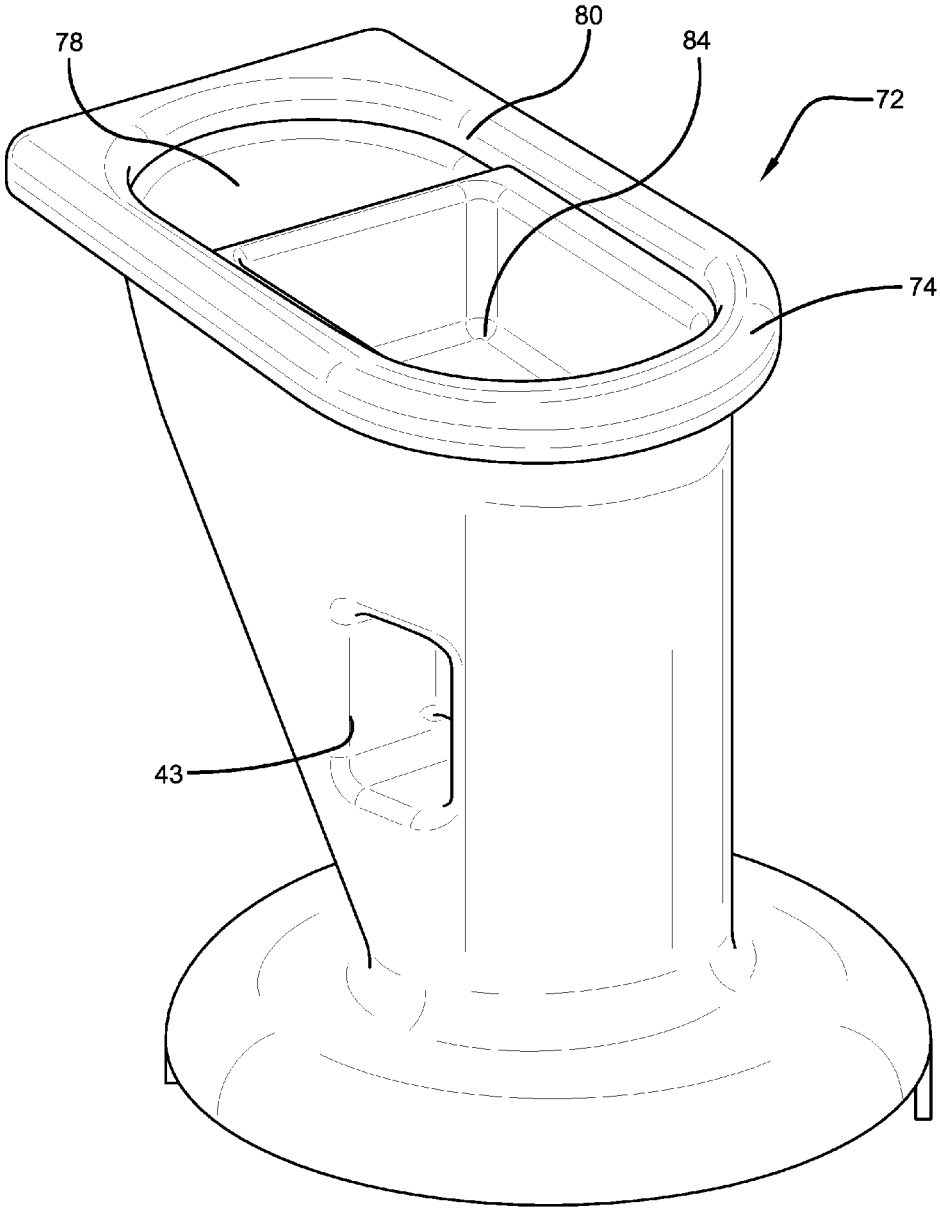
FIG. 18 is a first perspective view of a body portion of a chute assembly according to an embodiment of the invention.
Figure 19:
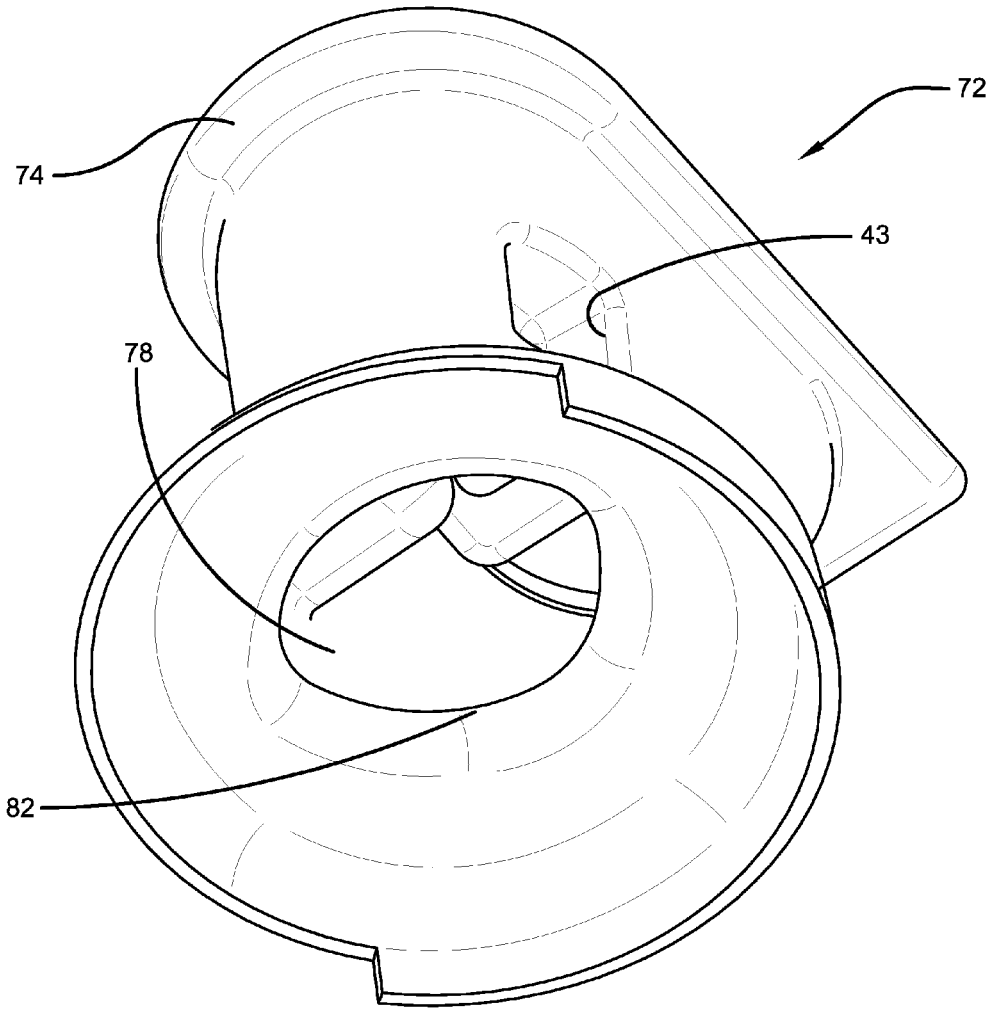
FIG. 19 is a second perspective view of a body portion of a chute assembly according to an embodiment of the invention.
Figure 37:
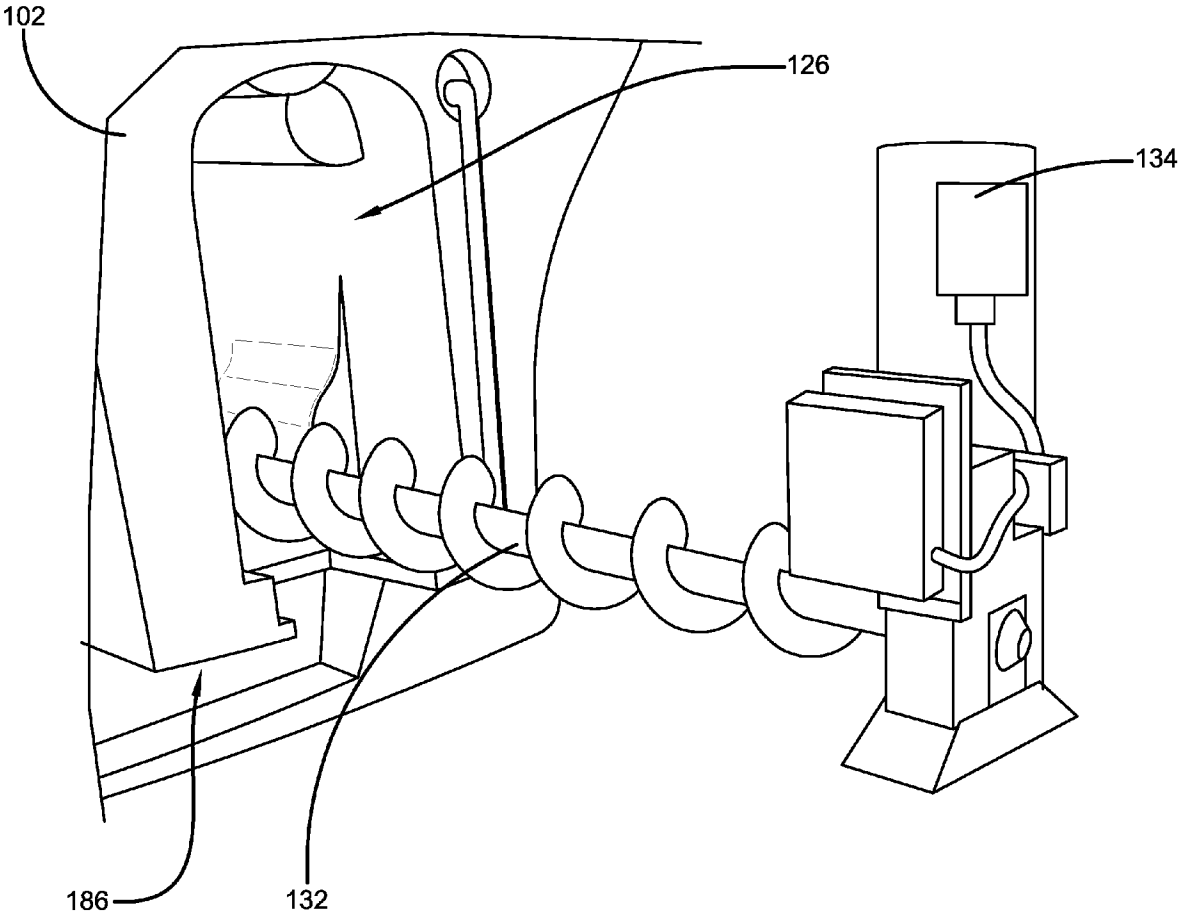
FIG. 37 is a perspective view of the back of the hopper showing the auger partially installed—and partially removed.

With reference to FIGS. 16-17, removal of the auger 46, 132 may be easily done. The drive 64*a* may be attached to the hopper 12*a* by first and second fasteners 66*a*, 68*a*. These fasteners 66*a*, 68*a* are preferably bolts. To remove the auger 46*a* and drive 64 requires simply removing the first and second fasteners 66*a*, 68*a* and then withdrawing the entire auger 46*a* and drive 64*a* combination from an opening 70*a* of the well 62*a*. Removal of auger 132 is also shown in FIG. 37. The ease with which the operative mechanical devices (auger, gear box, drive) may be removed from the hopper 12*a*, 102 is one of the benefits and features of the invention; as such access has previously been much more difficult and complicated. Such access is helpful when cleaning and maintaining the spreader assembly 10, 100.

The spreader assemblies 10, 100 may include a second mechanism that is supported to the hopper 12, 102 and used to move the liquid material from the chambers 27, 110 to the respective aperture 29, 114. In one embodiment, the second mechanism is a pump 190 used to pre-wet the solid material. The pump 190 and related components may be inserted with the well 126 and closed within with a plate 154. The second mechanism may have an easy access fill port with site indicator and a nozzle located directly above the spinner for effective liquid application.

The spreader assembly 10, 100 may include a chute assembly 16, 136. The chute assembly 16, 136 may receive the solid material discharged from the hopper 12, 102 through the aperture 60, 112. The chute assembly may include a body portion 72, 138 that is a one piece plastic component. FIGS. 18, 19 and 29, 30 show different views of the respective body portions 72, 138. To attach the chute assembly 16, 136 to the respective hopper 12, 102 a lip may be formed on one component and a slot may be formed on the other. For the embodiment shown, at a top end of the body portions 72, 138 integrally-formed lips 74, 140 are provided. The lips 74, 140 may be received in corresponding slots 76, 142 integrally formed in the respective hopper 12, 102 to attach the chute assembly 16, 136 to the hopper 12, 102. The chute assembly 16, 136 may attach to the hopper 12, 102 at the surface defining the bottom of the respective well 62, 126 as shown. No fasteners may be required. The body portion 72, 138 may include an integrally-formed through aperture 78, 44 with an intake 80, 146 and a discharge 82, 148. The solid material may be received in the intake 80, 146 pass through the through aperture 78, 144 and exit through the discharge 82, 148. The body portion 72, 138 may include first and second cavities 43, 43, 150, 150 that define handles on opposite sides of the body portion 72, 138, as shown.

Figure 21:
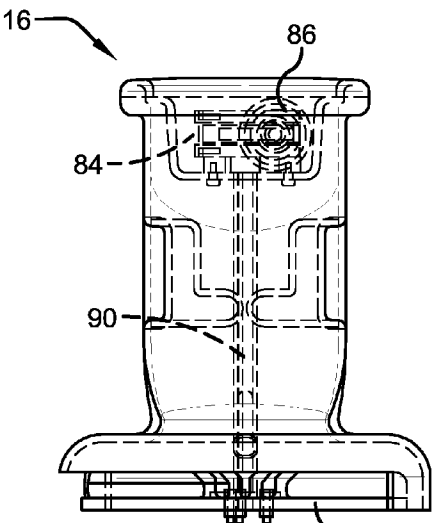
FIG. 21 is a front view of a chute assembly according to an embodiment of the invention; and, FIG. 22 is a side view of a chute assembly according to an embodiment of the invention.
Figure 20:
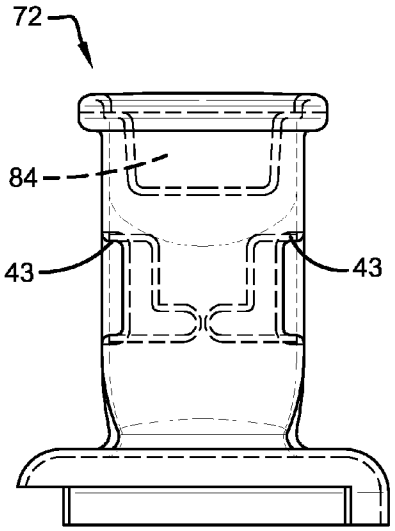
FIG. 20 is a front view of a body portion of a chute assembly according to an embodiment of the invention.
Figure 30:
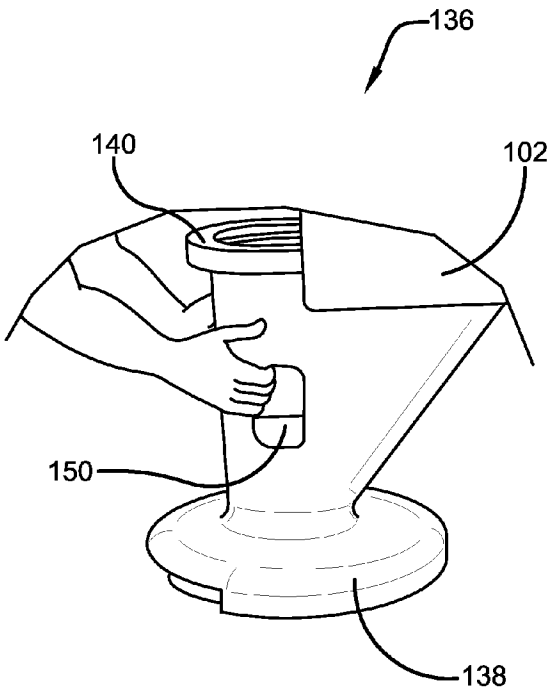
FIG. 30 is a side view of the chute assembly being adjusted by an operator.
Figure 29:
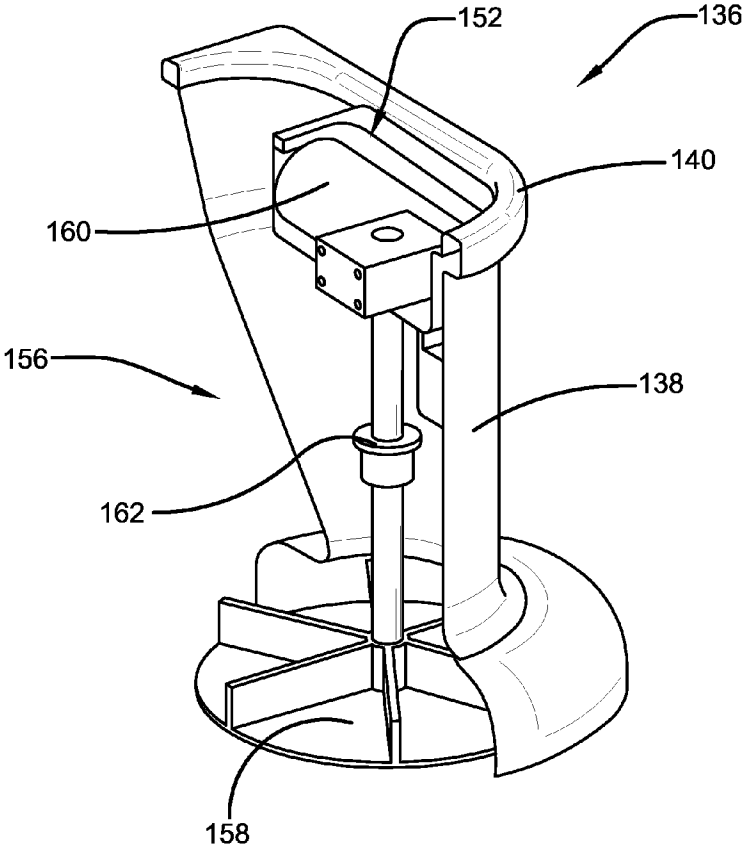
FIG. 29 is a perspective view, partially cut-away, of a spinner mechanism.
Figure 31:
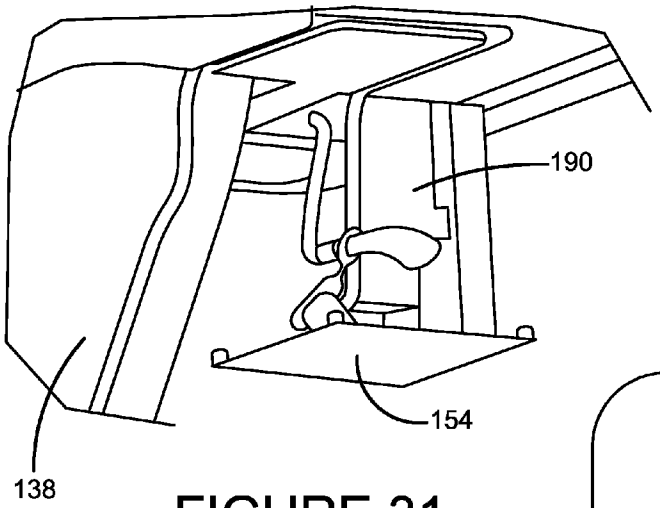
FIG. 31 is a perspective view of the pump assembly.

The spreader assembly 10, 100 may include a spinner mechanism 45, 156 having a plate 158 rotated by a drive 160 in a known manner. A relatively long shaft 90, 162 may attach the plate 88, 158 to the drive 86, 160. The drive 160 rotates the plate 158 so that when the solid material lands on the plate 158, it is spread broadly over the ground area. The body portion 72, 138 of the chute assembly 16, 136 may at least partially surround the plate, 158, the shaft 162 and the drive 160, as shown. In one embodiment, shown in FIGS. 21 and 22 and 29, the body portion 72 surrounds all the spinner mechanism 45, 156 except the plate 88, 158. The body portion 72, 138 may include an integrally-formed cavity 84, 152 for receiving or housing the spinner drive 160. The cavity 84 may be isolated from the through aperture 78. The chute assembly, including the spinner mechanism, may be easily manually adjustable by sliding the body portion 72, 138 with respect to the hopper 12, 102 between: (1) a first condition where the chute assembly 16, 136 is attached to the hopper (such as shown in FIGS. 23 and 24); and, (2) a second condition where the chute assembly 16, 136 is not attached to the hopper. FIG. 30 shows the chute assembly 136 being manually adjusted between the first and second conditions.

Figure 22:
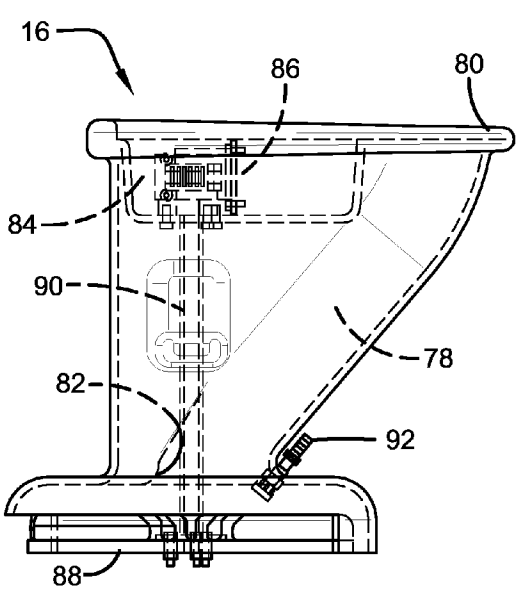
Figure 23:
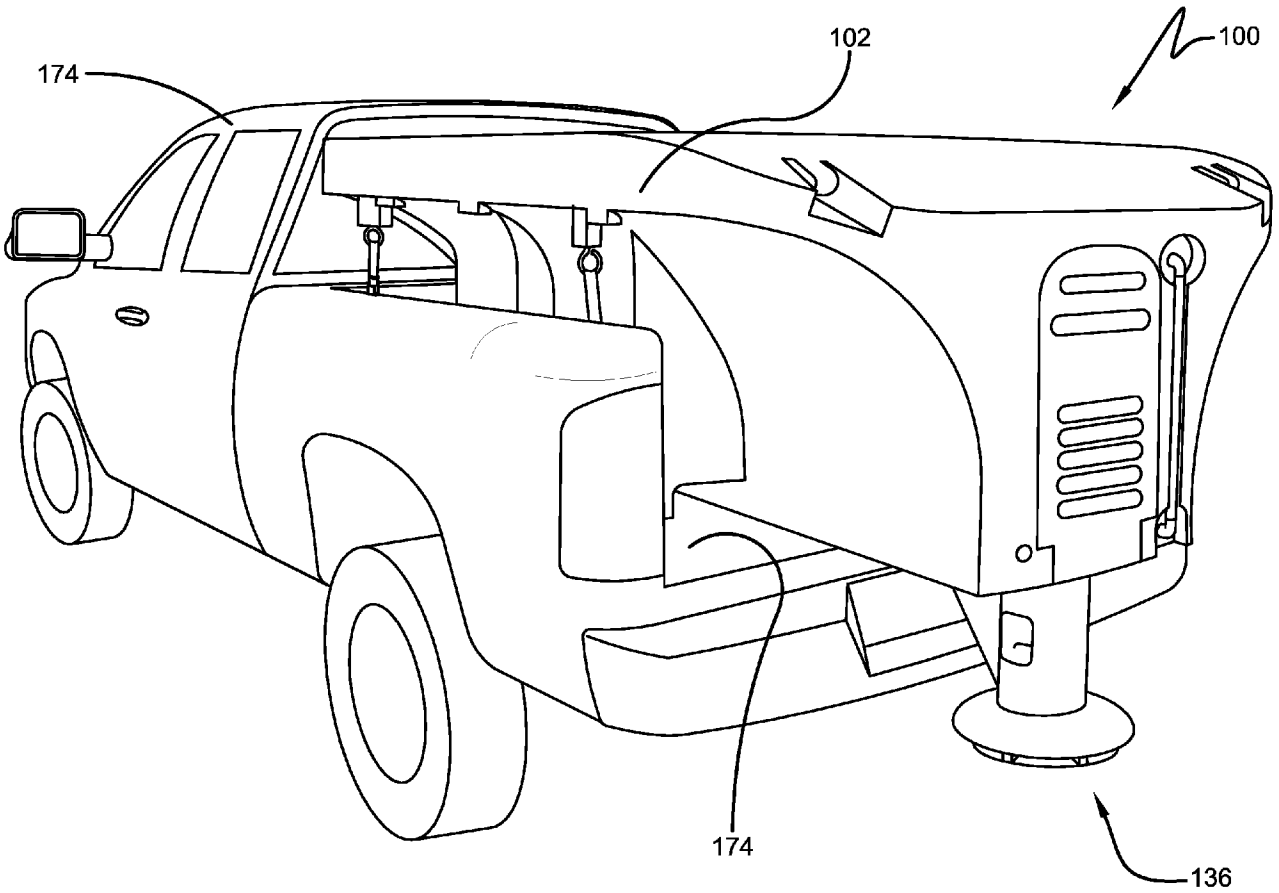
FIG. 23 is a perspective view of another embodiment of this invention mounted to the back of a pick-up truck.

FIG. 22 shows a fluid fitting 92 mounted on the body portion 72. The fitting 92 may engage a hose that also engages a fitting communicating with the interior of the hopper 12. As set forth above, the hopper 12 may be constructed of a first and second wall. This double-wall construction provides for a chamber between the first and second wall that has historically been filled with atmospheric air. Because the material often carried in the spreader body may be used in conjunction with liquid, such as brine or deicer, the area between the walls provides an attractive place from which to draw the liquid. While prior art spreader bodies included exterior tanks, often a 50-gallon size, to supplement the dry material (such as salt) with a liquid (such as brine), the subject spreader assembly 10 may selectively receive liquids within the first and second walls which may then be pumped out via electric liquid pump (not shown) and mixed with the solid materials as they are discharged on the road. The pump could be mounted in the well 62.

Figure 28:
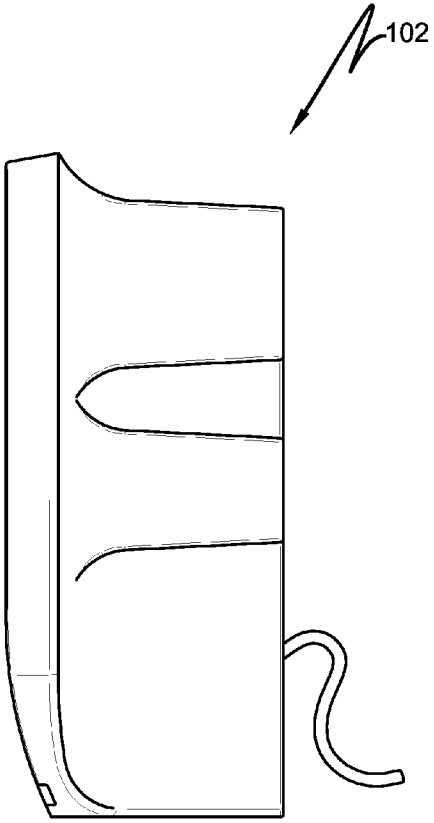
FIG. 28 is a side view of the hopper placed on its end, in a storage positioned.
Figure 27:
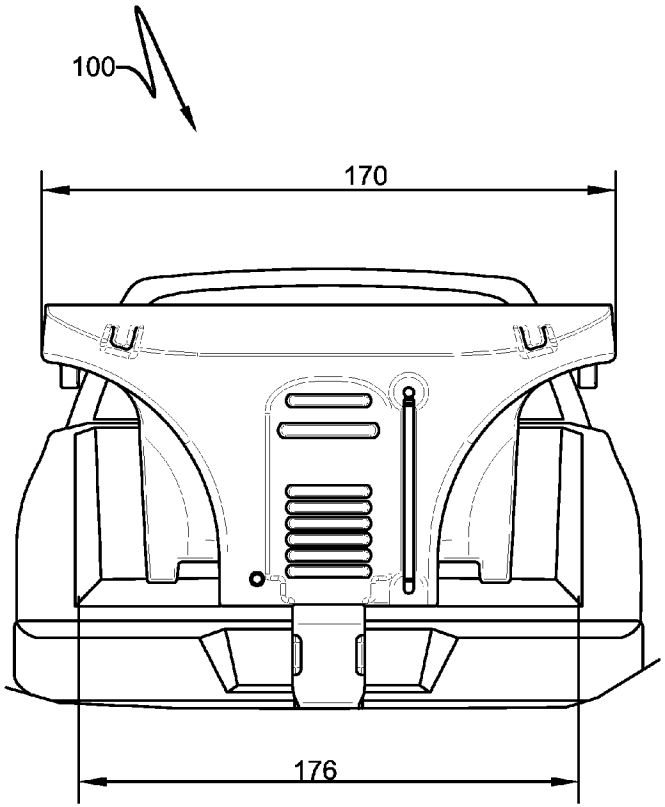
FIG. 27 is a back view of the invention shown in FIG. 23.

With reference to FIGS. 1 and 24, in one embodiment the back of the hopper 12, 102 may include a smooth tapering surface 96, 164. In addition to the attractive appearance, the smooth tapering surface 96, 104 may tend to discharge dirt and the like downwardly away from the receptacle 20, 106 and onto the ground surface. In another embodiment, illustrated in FIG. 27, the hopper 112 may have a top surface with a width 170 that is greater than the width 176 of the truck bed 172. This greatly reduces material spillage into the bed 172. The hopper 12, 102 (see FIG. 26) may have various hooks 178 suitable for receiving tarps 180 or other surface coverings. The hopper 12, 102 back end may have a substantially flat surface that is substantially perpendicular to the truck bed when installed so that it is easy to store the hopper 102 in an upright position, as shown in FIG. 28, without taking up very much storage space.

Figure 32:
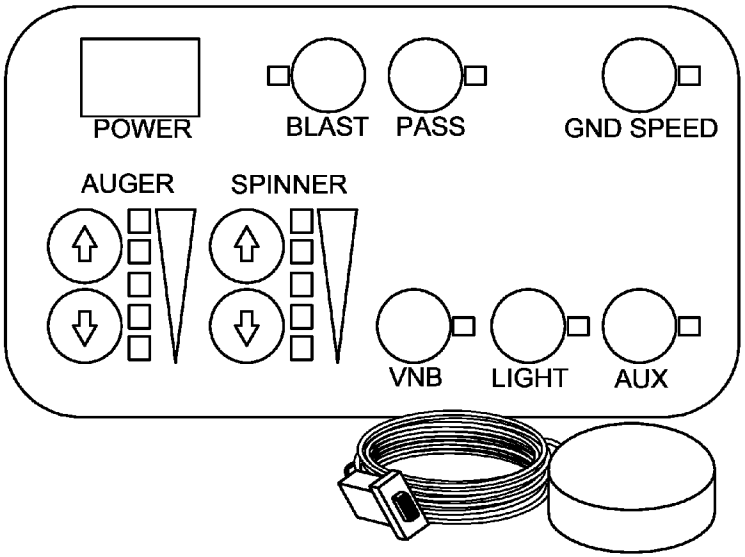
FIG. 32 is a view of a controller.
Figure 34:
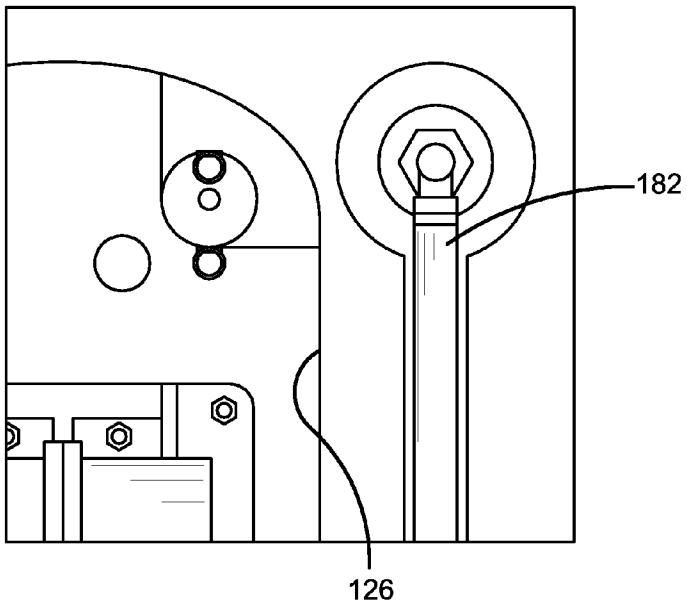
FIG. 34 is another close-up back view of the hopper.
Figure 33:
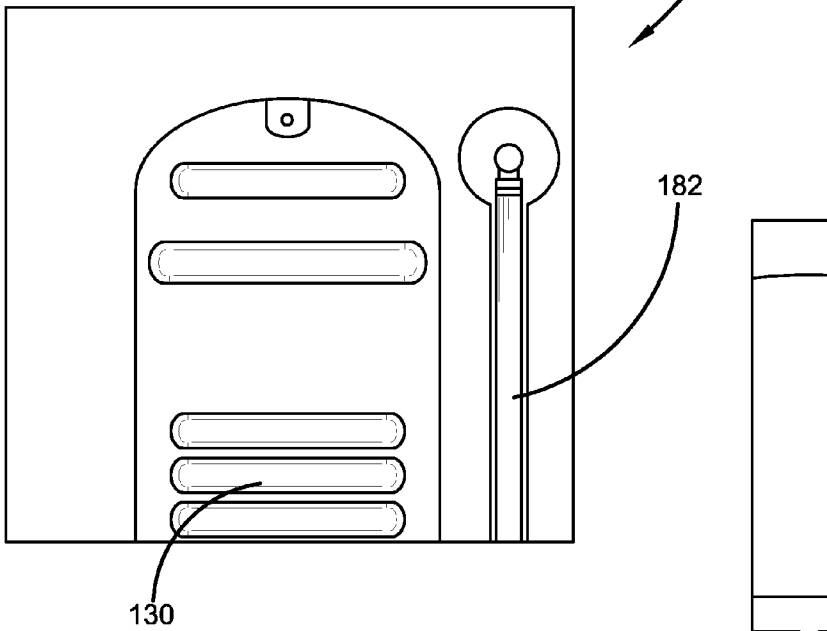
FIG. 33 is a close-up back view of the hopper shown in FIG. 23.
Figure 35:
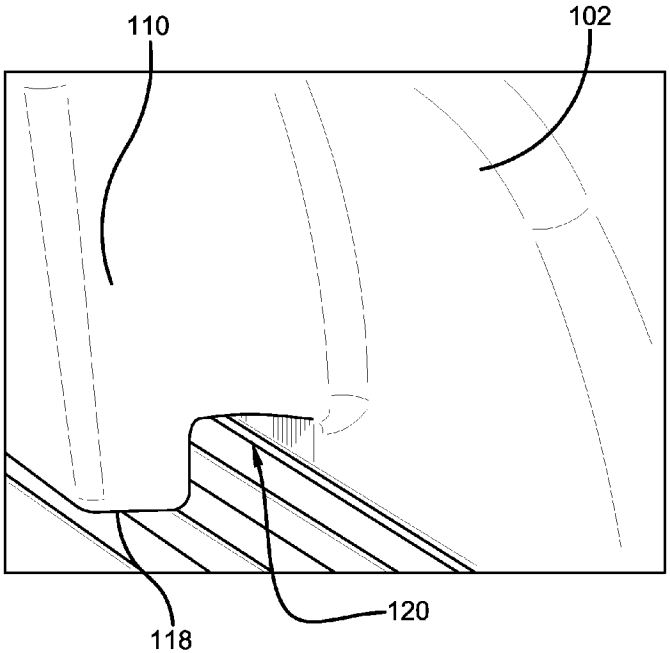
FIG. 35 is a close-up view of a chamber.
Figure 36:
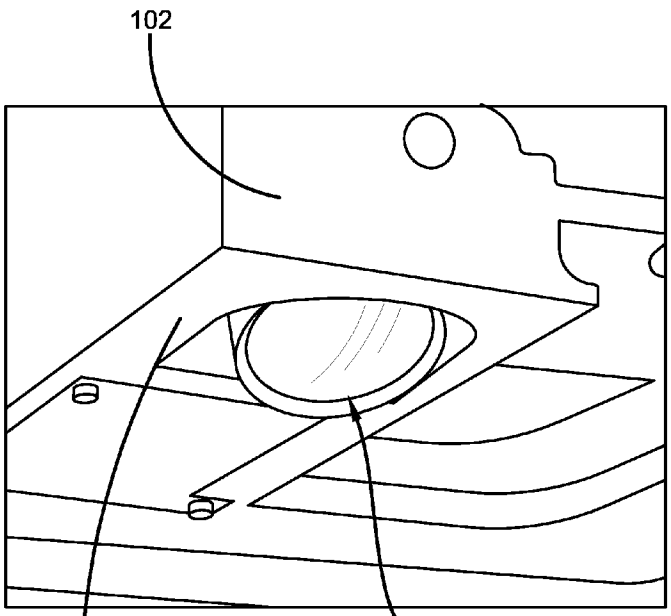
FIG. 36 is a close-up view showing a work light.

With reference to FIGS. 24, 33 and 34, a sight indicator 182 may be used to show the liquid levels at a glance. For the embodiment shown, the sight indicator 182 may be positioned on the back surface of the hopper 102. A work light 186, see FIG. 36, may be placed on a bottom surface 188 of the hopper 102. For the embodiment shown, the bottom surface 188 extends outside the bed 172, as shown in FIG. 37, so that it illuminates material placement and helps in maintenance operations. FIG. 32 shows a controller 184 which can be used to control the spreader assembly 100. The controller 184 may be wired or wireless and may be positioned in any convenient location chosen with the sound judgment of a person of skill in the art, such as within the cab of the pick-up truck 174. The controller 184 may include independent controls for the various drives used with the pump, auger and spinner. Additional functions may include a pre-wet blast, pause, work light, vibrator and optional GPS ground speed control.

Numerous embodiments have been described herein. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

Having thus described the invention, it is now claimed:

1. A method for a spreader assembly comprising the steps of:

(A) forming an insert hopper into a one piece plastic component in a rotational molding operation;

(B) providing the insert hopper with: an inner surface defining a receptacle; an outer surface; a first chamber formed between the inner surface and the outer surface; a first aperture formed on the outer surface that communicates with the receptacle; and, a second aperture formed on the outer surface that communicates with the first chamber;

(C) providing a first mechanism that is supported to the hopper;

(D) providing a second mechanism that is supported to the hopper;

(E) providing a chute assembly supported to the hopper, wherein the first and second apertures extend to an intake of the chute assembly;

(F) wherein the spreader assembly is operable to perform the following steps:

(1) mounting the insert hopper onto a bed of a pick-up truck;

(2) placing a solid material into the receptacle;

(3) placing a liquid material into the first chamber;

(4) operating the first mechanism to move the solid material from the receptacle, to the first aperture and, onto a ground surface; and, (5) operating the second mechanism to move the liquid material from the first chamber, to the second aperture and, onto the solid material before the solid material contacts the ground surface.

2. The method of claim 1 wherein:

step (B) comprises the steps of: providing the first chamber on a first side of the receptacle; and, providing a second chamber formed between the inner surface and the outer surface on an opposite side of the receptacle;

step (F)(3) comprises the step of: placing the liquid material into the second chamber; and, step (F)(5) comprises the step of: operating the second mechanism to move the liquid material from the second chamber to the second aperture.

3. The method of claim 2 wherein:

step (B) comprises the steps of: providing the hopper with a bottom surface positioned directly below the receptacle; and, providing the first chamber with a bottom surface that is positioned laterally outside the bottom surface of the hopper that is positioned directly below the receptacle;

step (C) comprises the step of: supporting the first mechanism directly above the bottom surface of the hopper that is positioned directly below the receptacle; and, step (F1) comprises the steps of: supporting the hopper to the bed by contacting the bed with: the bottom surface of the hopper that is positioned directly below the receptacle; and, the bottom surface of the first chamber.

4. The method of claim 1 wherein:

step (B) comprises the steps of: providing the insert hopper with a back end when mounted to the pick-up truck; and, providing the back end of the insert hopper with a well separated from the receptacle by a wall;

step (C) comprises the step of extending the first mechanism through the receptacle, through the wall and into the well;

the method further comprises the steps of: providing a drive that is attached to the first mechanism and that is positioned within the well; and, step (F)(4) comprises the step of: operating the drive to operate the first mechanism to move the solid material from the receptacle to the first aperture.

5. The method of claim 4 further comprising the step of removing the first mechanism and drive by:

removing one or more fasteners that hold the drive to the insert hopper; and, removing the first mechanism and drive together in combination from the insert hopper by withdrawing them through an opening of the well.

6. The method of claim 1 wherein:

step (B) comprises the steps of: providing the insert hopper with a back end when mounted to the pick-up truck; and, providing the back end of the insert hopper with a well separated from the receptacle by a wall;

step (D) comprises the steps of: providing the second mechanism to be a pump; and, positioning the pump within the well; and, step (F)(5) comprises the step of: operating the pump to move the liquid material from the first chamber, to the second aperture and, onto the solid material before the solid material contacts the ground surface.

7. The method of claim 1 wherein:

step (E) comprises the step of: providing the chute assembly with a body portion that: is a one piece plastic component; comprises a through aperture having the intake and a discharge;

comprises a first cavity on a first side of the body that defines a first handle; and, comprises a second cavity on a second side of the body that defines a second handle;

the method further comprises the step of: providing: a lip formed on one of the chute assembly and the hopper; and, a slot formed on the other of the chute assembly and the hopper; and, the spreader assembly is operable to perform the following step: manually adjusting the chute assembly by sliding the body portion with respect to the hopper as the lip moves with respect to the slot between: (1) a first condition where the chute assembly is attached to the insert hopper and communicates the solid material from the first aperture to the plate; and, (2) a second condition where the chute assembly is not attached to the insert hopper.

8. The method of claim 1 further comprising the steps of:

providing a spinner mechanism comprising a drive and a plate that is rotated by the drive;

positioning the spinner mechanism within the chute assembly; and, wherein the spinner mechanism is operable to rotate the plate to spread the solid material that lands on the plate onto the ground surface.

9. The method of claim 1 wherein:

step (B) comprises the step of: providing the insert hopper with a top surface having a width that is greater than a width of the pick-up truck bed; and, step (F)(1) comprises the step of: mounting the insert hopper onto the pick-up truck bed with the top surface of the insert hopper extending beyond the pick-up truck bed on each side of the pick-up truck bed.

10. The method of claim 1 wherein:

step (B) comprises the steps of: providing the insert hopper with a bottom surface; and, providing a work light on the bottom surface; and, step (F)(1) comprises the step of: mounting the insert hopper onto the pick-up truck bed with the work light positioned outside the pick-up truck bed to illuminate material placement.

11. A method for a spreader assembly comprising the steps of:

(A) providing an insert hopper with: an inner surface defining a receptacle; an outer surface; first and second chambers formed between the inner surface and the outer surface on opposite sides of the receptacle; a first aperture formed on the outer surface that communicates with the receptacle; and, a second aperture formed on the outer surface that communicates with the first and second chambers;

(B) providing a first mechanism that is supported within the hopper;

(C) providing a second mechanism that is supported to the hopper;

(D) providing a chute assembly supported to the hopper, wherein the first and second apertures extend to an intake of the chute assembly;

(E) wherein the spreader assembly is operable to perform the following steps:

(1) mounting the insert hopper onto a bed of a pick-up truck;

(2) placing a solid material into the receptacle;

(3) placing a liquid material into the first and second chambers;

(4) operating the first mechanism to move the solid material from the receptacle, to the first aperture and, onto a ground surface; and, (5) operating the second mechanism to move the liquid material from the first and second chambers, to the second aperture.

12. The method of claim 11 wherein:

step (A) comprises the steps of: providing the insert hopper with a bottom surface positioned directly below the receptacle; and, providing the first and second chambers with bottom surfaces that are positioned laterally outside the bottom surface of the hopper that is positioned directly below the receptacle; and, step (E)(1) comprises the steps of: supporting the hopper to the bed by contacting the bed with: the bottom surface of the hopper that is positioned directly below the receptacle; the bottom surface of the first chamber; and, the bottom surface of the second chamber.

13. The method of claim 12 wherein:

step (A) comprises the steps of: providing a first groove that separates the bottom surface of the first chamber from the bottom surface of the hopper; and, providing a second groove that separates the bottom surface of the second chamber from the bottom surface of the hopper; and, step (E)(1) comprises the step of: using at least one of the first and second grooves as a lifting pocket when mounting the insert hopper onto the pick-up truck bed.

14. The method of claim 11 wherein:

step (A) comprises the steps of: providing the insert hopper with a back end when mounted to the pick-up truck; and, providing the back end of the insert hopper with a well separated from the receptacle by a wall;

step (B) comprises the step of extending the first mechanism through the receptacle, through the wall and into the well;

the method further comprises the steps of: providing a drive that is attached to the first mechanism and that is positioned within the well; and, step (E)(4) comprises the step of: operating the drive to operate the first mechanism to move the solid material from the receptacle to the first aperture.

15. The method of claim 14 further comprising the step of removing the first mechanism and drive by:

removing one or more fasteners that hold the drive to the insert hopper; and, removing the first mechanism and drive together in combination from the insert hopper by withdrawing them through an opening of the well.

16. The method of claim 11 wherein:

step (A) comprises the steps of: providing the insert hopper with a back end when mounted to the pick-up truck; and, providing the back end of the insert hopper with a well separated from the receptacle by a wall;

step (C) comprises the steps of: providing the second mechanism to be a pump; and, positioning the pump within the well; and, step (E)(5) comprises the step of: operating the pump to move the liquid material from the first chamber, to the second aperture and, onto the solid material before the solid material contacts the ground surface.

17. The method of claim 11 wherein:

step (D) comprises the step of: providing the chute assembly with a body portion that: is a one piece plastic component; comprises a through aperture having the intake and a discharge;

comprises a first cavity on a first side of the body that defines a first handle; and, comprises a second cavity on a second side of the body that defines a second handle;

the method further comprises the step of: providing: a lip formed on one of the chute assembly and the hopper; and, a slot formed on the other of the chute assembly and the hopper; and, the spreader assembly is operable to perform the following step: manually adjusting the chute assembly by sliding the body portion with respect to the hopper as the lip moves with respect to the slot between: (1) a first condition where the chute assembly is attached to the insert hopper and communicates the solid material from the first aperture to the plate; and, (2) a second condition where the chute assembly is not attached to the insert hopper.

18. The method of claim 11 further comprising the steps of:

providing a spinner mechanism comprising a drive and a plate that is rotated by the drive;

positioning the spinner mechanism within the chute assembly; and, wherein the spinner mechanism is operable to rotate the plate to spread the solid material that lands on the plate onto the ground surface.

19. The method of claim 11 wherein:

step (A) comprises the step of: providing the insert hopper with a top surface having a width that is greater than a width of the pick-up truck bed; and, step (E)(1) comprises the step of: mounting the insert hopper onto the pick-up truck bed with the top surface of the insert hopper extending beyond the pick-up truck bed on each side of the pick-up truck bed.

20. The method of claim 11 wherein:

step (A) comprises the steps of: providing the insert hopper with a bottom surface; and, providing a work light on the bottom surface; and, step (E)(1) comprises the step of: mounting the insert hopper onto the pick-up truck bed with the work light positioned outside the pick-up truck bed to illuminate material placement.

* * * * *